US005943011A

United States Patent [19]

Acoraci et al.

[11] Patent Number: 5,943,011

[45] Date of Patent: Aug. 24, 1999

[54] ANTENNA ARRAY USING SIMPLIFIED BEAM FORMING NETWORK

[75] Inventors: Joseph H. Acoraci, Phoenix; Henry H. Nguyen, Cockeysville, both of Md.

[73] Assignee: Raytheon Company, Lexington, Mass.

[21] Appl. No.: 08/957,657

[22] Filed: Oct. 24, 1997

[51] Int. Cl.[6] ..... H01Q 3/22

[52] U.S. Cl. ..... 342/373; 342/374; 342/427

[58] Field of Search ..... 342/373, 374, 342/427

[56] References Cited

U.S. PATENT DOCUMENTS 3,729,742 4/1973 Boyns ..... 343/854
4,316,192 2/1982 Acoraci ..... 343/100 SA
4,827,270 5/1989 Udagawa et al. ..... 343/853
4,912,477 3/1990 Lory et al. ..... 342/373
5,028,930 7/1991 Evans ..... 342/373
5,506,589 4/1996 Quan et al. ..... 342/373
5,686,926 11/1997 Kijima et al. ..... 342/373

*Primary Examiner*—Mark Hellner
*Attorney, Agent, or Firm*—Daly, Crowley & Mofford, LLP

[57] ABSTRACT

An antenna array for identifying aircrafts operating in a region of interest. The antenna includes a beam forming means and an antenna means. The beam forming means receives, processes and routes a sum and difference beam pattern to the antenna means. The antenna means transmits the sum and difference beam patterns to five separate beam locations in space.

20 Claims, 21 Drawing Sheets

BEAM LOCATION A

SUM BEAM PATTERN AT INPUT
0 dB/0 deg
1 WATT/0 deg

| ANTENNA ELEMENT | RF SIGNAL FROM PORT A | | RF SIGNAL FROM PORT D | | RESULTANT SIGNAL AT ELEMENT | | DELAYED SPACE PHASE | RF SIGNAL EXISTING AT LINE PERPENDICULAR TO 4 ELEMENTS | |
|---|---|---|---|---|---|---|---|---|---|
| | (dB) | (deg) | (dB) | (deg) | (dB) | (deg) | (deg) | (dB) | (deg) |
| 51 | -9.031 | +45.0 | -9.031 | +180.0 | -11.354 | +112.5 | 0.0 | -11.354 | +112.5 |
| 52 | -9.031 | +90.0 | -9.031 | +135.0 | -3.698 | +112.5 | 0.0 | -3.698 | +112.5 |
| 53 | -9.031 | +135.0 | -9.031 | +90.0 | -3.698 | +112.5 | 0.0 | -3.698 | +112.5 |
| 54 | -9.031 | +180.0 | -9.031 | +45.0 | -11.354 | +112.5 | 0.0 | -11.354 | +112.5 |
| 55 | X | X | X | X | X | X | X | X | X |
| 56 | X | X | X | X | X | X | X | X | X |
| 57 | X | X | X | X | X | X | X | X | X |
| 58 | X | X | X | X | X | X | X | X | X |

BEAM LOCATION A

DIFFERENCE BEAM PATTERN AT INPUT
0 dB/0 deg
1 WATT/0 deg

| ANTENNA ELEMENT | RF SIGNAL FROM PORT A | | RF SIGNAL FROM PORT D | | RESULTANT SIGNAL AT ELEMENT | | DELAYED SPACE PHASE | RF SIGNAL EXISTING AT LINE PERPENDICULAR TO 4 ELEMENTS | |
|---|---|---|---|---|---|---|---|---|---|
| | (dB) | (deg) | (dB) | (deg) | (dB) | (deg) | (deg) | (dB) | (deg) |
| 51 | -9.031 | +45.0 | -9.031 | 0.0 | -3.698 | +22.5 | 0.0 | -3.698 | +22.5 |
| 52 | -9.031 | +90.0 | -9.031 | -45.0 | -11.354 | +22.5 | 0.0 | -11.354 | +22.5 |
| 53 | -9.031 | +135.0 | -9.031 | -90.0 | -11.354 | -157.5 | 0.0 | -11.354 | -157.5 |
| 54 | -9.031 | +180.0 | -9.031 | -135.0 | -3.698 | -157.5 | 0.0 | -3.698 | -157.5 |
| 55 | X | X | X | X | X | X | X | X | X |
| 56 | X | X | X | X | X | X | X | X | X |
| 57 | X | X | X | X | X | X | X | X | X |
| 58 | X | X | X | X | X | X | X | X | X |

Figure 9

| BEAM LOCATION B<br>SUM BEAM PATTERN AT INPUT<br>0 dB/0 deg<br>1 WATT/0 deg | | | | | | | | | |
|---|---|---|---|---|---|---|---|---|---|
| ANTENNA ELEMENT | RF SIGNAL FROM PORT B | | RF SIGNAL FROM PORT D | | RESULTANT SIGNAL AT ELEMENT | | DELAYED SPACE PHASE | RF SIGNAL EXISTING AT LINE PERPENDICULAR TO 4 ELEMENTS | |
| | (dB) | (deg) | (dB) | (deg) | (dB) | (deg) | (deg) | (dB) | (deg) |
| 51 | -9.031 | -45.0 | -9.031 | +180.0 | -11.354 | -112.52 | 0.0 | -11.354 | -112.52 |
| 52 | -9.031 | +180.0 | -9.031 | +135.0 | -3.698 | +157.5 | 0.0 | -3.698 | +157.5 |
| 53 | -9.031 | +45.0 | -9.031 | +90.0 | -3.698 | +67.5 | 0.0 | -3.698 | +67.5 |
| 54 | -9.031 | -90.0 | -9.031 | +45.0 | -11.354 | -22.5 | 0.0 | -11.354 | -22.5 |
| 55 | X | X | X | X | X | X | X | X | X |
| 56 | X | X | X | X | X | X | X | X | X |
| 57 | X | X | X | X | X | X | X | X | X |
| 58 | X | X | X | X | X | X | X | X | X |

| BEAM LOCATION B<br>DIFFERENCE BEAM PATTERN AT INPUT<br>0 dB/0 deg<br>1 WATT/0 deg | | | | | | | | | |
|---|---|---|---|---|---|---|---|---|---|
| ANTENNA ELEMENT | RF SIGNAL FROM PORT B | | RF SIGNAL FROM PORT D | | RESULTANT SIGNAL AT ELEMENT | | DELAYED SPACE PHASE | RF SIGNAL EXISTING AT LINE PERPENDICULAR TO 4 ELEMENTS | |
| | (dB) | (deg) | (dB) | (deg) | (dB) | (deg) | (deg) | (dB) | (deg) |
| 51 | -9.031 | -45.0 | -9.031 | 0.0 | -3.698 | -22.5 | 0.0 | -3.698 | -22.5 |
| 52 | -9.031 | +180.0 | -9.031 | -45.0 | -11.354 | -112.5 | 0.0 | -11.354 | -112.5 |
| 53 | -9.031 | +45.0 | -9.031 | -90.0 | -11.354 | -22.5 | 0.0 | -11.354 | -22.5 |
| 54 | -9.031 | -90.0 | -9.031 | -135.0 | -3.698 | -112.5 | 0.0 | -3.698 | -112.5 |
| 55 | X | X | X | X | X | X | X | X | X |
| 56 | X | X | X | X | X | X | X | X | X |
| 57 | X | X | X | X | X | X | X | X | X |
| 58 | X | X | X | X | X | X | X | X | X |

Figure 13

BEAM LOCATION C

SUM BEAM PATTERN AT INPUT
0 dB/0 deg
1 WATT/0 deg

| ANTENNA ELEMENT | RF SIGNAL FROM PORT B | | RF SIGNAL FROM PORT G | | RESULTANT SIGNAL AT ELEMENT | | DELAYED SPACE PHASE | RF SIGNAL EXISTING AT LINE PERPENDICULAR TO 8 ELEMENT CENTERLINE | |
|---|---|---|---|---|---|---|---|---|---|
| | (dB) | (deg) | (dB) | (deg) | (dB) | (deg) | (deg) | (dB) | (deg) |
| 51 | -9.031 | -45.0 | X | X | -9.031 | -45.0 | -45.0 | -9.031 | -90.0 |
| 52 | -9.031 | +180.0 | X | X | -9.031 | +180.0 | +90.0 | -9.031 | -90.0 |
| 53 | -9.031 | +45.0 | X | X | -9.031 | +45.0 | -135.0 | -9.031 | -90.0 |
| 54 | -9.031 | -90.0 | X | X | -9.031 | -90.0 | 0.0 | -9.031 | -90.0 |
| 55 | X | X | -9.031 | -90.0 | -9.031 | -90.0 | 0.0 | -9.031 | -90.0 |
| 56 | X | X | -9.031 | +45.0 | -9.031 | +45.0 | -135.0 | -9.031 | -90.0 |
| 57 | X | X | -9.031 | +180.0 | -9.031 | +180.0 | +90.0 | -9.031 | -90.0 |
| 58 | X | X | -9.031 | -45.0 | -9.031 | -45.0 | -45.0 | -9.031 | -90.0 |

BEAM LOCATION C

DIFFERENCE BEAM PATTERN AT INPUT
0 dB/0 deg
1 WATT/0 deg

| ANTENNA ELEMENT | RF SIGNAL FROM PORT B | | RF SIGNAL FROM PORT G | | RESULTANT SIGNAL AT ELEMENT | | DELAYED SPACE PHASE | RF SIGNAL EXISTING AT LINE PERPENDICULAR TO 4 ELEMENTS | |
|---|---|---|---|---|---|---|---|---|---|
| | (dB) | (deg) | (dB) | (deg) | (dB) | (deg) | (deg) | (dB) | (deg) |
| 51 | -9.031 | -45.0 | X | X | -9.031 | -45.0 | -45.0 | -9.031 | -90.0 |
| 52 | -9.031 | +180.0 | X | X | -9.031 | +180.0 | +90.0 | -9.031 | -90.0 |
| 53 | -9.031 | +45.0 | X | X | -9.031 | +45.0 | -135.0 | -9.031 | -90.0 |
| 54 | -9.031 | -90.0 | X | X | -9.031 | -90.0 | 0.0 | -9.031 | -90.0 |
| 55 | X | X | -9.031 | +90.0 | -9.031 | +90.0 | 0.0 | -9.031 | +90.0 |
| 56 | X | X | -9.031 | -135.0 | -9.031 | -135.0 | -135.0 | -9.031 | +90.0 |
| 57 | X | X | -9.031 | 0.0 | -9.031 | 0.0 | +90.0 | -9.031 | +90.0 |
| 58 | X | X | -9.031 | +135.0 | -9.031 | +135.0 | -45.0 | -9.031 | +90.0 |

Figure 17

| BEAM LOCATION D<br>SUM BEAM PATTERN AT INPUT<br>0 dB/0 deg<br>1 WATT/0 deg | | | | | | | | | |
|---|---|---|---|---|---|---|---|---|---|
| ANTENNA ELEMENT | RF SIGNAL FROM PORT G | | RF SIGNAL FROM PORT E | | RESULTANT SIGNAL AT ELEMENT | | DELAYED SPACE PHASE | RF SIGNAL EXISTING AT LINE PERPENDICULAR TO 4 ELEMENTS | |
| | (dB) | (deg) | (dB) | (deg) | (dB) | (deg) | (deg) | (dB) | (deg) |
| 51 | X | X | X | X | X | X | X | X | X |
| 52 | X | X | X | X | X | X | X | X | X |
| 53 | X | X | X | X | X | X | X | X | X |
| 54 | X | X | X | X | X | X | X | X | X |
| 55 | -9.031 | -90.0 | -9.031 | +45.0 | -11.354 | -22.5 | 0.0 | -11.354 | -22.5 |
| 56 | -9.031 | +45.0 | -9.031 | +90.0 | -3.698 | +67.5 | 0.0 | -3.698 | +67.5 |
| 57 | -9.031 | +180.0 | -9.031 | +135.0 | -3.698 | +157.5 | 0.0 | -3.698 | +157.5 |
| 58 | -9.031 | -45.0 | -9.031 | +180.0 | -11.354 | -112.5 | 0.0 | -11.354 | -112.5 |

| BEAM LOCATION D<br>DIFFERENCE BEAM PATTERN AT INPUT<br>0 dB/0 deg<br>1 WATT/0 deg | | | | | | | | | |
|---|---|---|---|---|---|---|---|---|---|
| ANTENNA ELEMENT | RF SIGNAL FROM PORT G | | RF SIGNAL FROM PORT E | | RESULTANT SIGNAL AT ELEMENT | | DELAYED SPACE PHASE | RF SIGNAL EXISTING AT LINE PERPENDICULAR TO 4 ELEMENTS | |
| | (dB) | (deg) | (dB) | (deg) | (dB) | (deg) | (deg) | (dB) | (deg) |
| 51 | X | X | X | X | X | X | X | X | X |
| 52 | X | X | X | X | X | X | X | X | X |
| 53 | X | X | X | X | X | X | X | X | X |
| 54 | X | X | X | X | X | X | X | X | X |
| 55 | -9.031 | +90.0 | -9.031 | +45.0 | -3.698 | +67.5 | 0.0 | -3.698 | +67.5 |
| 56 | -9.031 | -135.0 | -9.031 | +90.0 | -11.354 | +157.5 | 0.0 | -11.354 | +157.5 |
| 57 | -9.031 | 0.0 | -9.031 | +135.0 | -11.354 | +67.5 | 0.0 | -11.354 | +67.5 |
| 58 | -9.031 | +135.0 | -9.031 | +180.0 | -3.698 | +157.5 | 0.0 | -3.698 | +157.5 |

Figure 21

| BEAM LOCATION E<br>SUM BEAM PATTERN AT INPUT<br>0 dB/0 deg<br>1 WATT/0 deg | | | | | | | | | |
|---|---|---|---|---|---|---|---|---|---|
| ANTENNA ELEMENT | RF SIGNAL FROM PORT H | | RF SIGNAL FROM PORT E | | RESULTANT SIGNAL AT ELEMENT | | DELAYED SPACE PHASE | RF SIGNAL EXISTING AT LINE PERPENDICULAR TO 4 ELEMENTS | |
| | (dB) | (deg) | (dB) | (deg) | (dB) | (deg) | (deg) | (dB) | (deg) |
| 51 | X | X | X | X | X | X | X | X | X |
| 52 | X | X | X | X | X | X | X | X | X |
| 53 | X | X | X | X | X | X | X | X | X |
| 54 | X | X | X | X | X | X | X | X | X |
| 55 | -9.031 | +180.0 | -9.031 | +45.0 | -11.354 | +112.5 | 0.0 | -11.354 | +112.5 |
| 56 | -9.031 | +135.0 | -9.031 | +90.0 | -3.698 | +112.5 | 0.0 | -3.698 | +112.5 |
| 57 | -9.031 | +90.0 | -9.031 | +135.0 | -3.698 | +112.5 | 0.0 | -3.698 | +112.5 |
| 58 | -9.031 | +45.0 | -9.031 | +180.0 | -11.354 | +112.5 | 0.0 | -11.354 | +112.5 |

| BEAM LOCATION E<br>DIFFERENCE BEAM PATTERN AT INPUT<br>0 dB/0 deg<br>1 WATT/0 deg | | | | | | | | | |
|---|---|---|---|---|---|---|---|---|---|
| ANTENNA ELEMENT | RF SIGNAL FROM PORT H | | RF SIGNAL FROM PORT E | | RESULTANT SIGNAL AT ELEMENT | | DELAYED SPACE PHASE | RF SIGNAL EXISTING AT LINE PERPENDICULAR TO 4 ELEMENTS | |
| | (dB) | (deg) | (dB) | (deg) | (dB) | (deg) | (deg) | (dB) | (deg) |
| 51 | X | X | X | X | X | X | X | X | X |
| 52 | X | X | X | X | X | X | X | X | X |
| 53 | X | X | X | X | X | X | X | X | X |
| 54 | X | X | X | X | X | X | X | X | X |
| 55 | -9.031 | 0.0 | -9.031 | +45.0 | -3.698 | +22.5 | 0.0 | -3.698 | +22.5 |
| 56 | -9.031 | -45.0 | -9.031 | +90.0 | -11.354 | +22.5 | 0.0 | -11.354 | +22.5 |
| 57 | -9.031 | -90.0 | -9.031 | +135.0 | -11.354 | -157.5 | 0.0 | -11.354 | -157.5 |
| 58 | -9.031 | -135.0 | -9.031 | +180.0 | -3.698 | -157.5 | 0.0 | -3.698 | -157.5 |

Figure 25

ANTENNA ARRAY USING SIMPLIFIED BEAM FORMING NETWORK

BACKGROUND OF THE INVENTION

A) Field of the Invention

The present invention relates to an antenna array, and more particularly to an antenna array which uses a simplified beam forming network.

B) Description of Related Art

FIG. 1 shows a conventional antenna array 10. The antenna array 10 includes an antenna component 20 and a beam forming network 30. The antenna component 20 includes five individual antenna elements 21–25, whereas, the beam forming network 30 includes a complex set of hardware to receive, process and route a sum beam pattern 31 and a difference beam pattern 33 to the antenna component 20.

The conventional antenna array 10, as shown in FIG. 2, is capable of radiating the sum and difference beam patterns 31 and 33 to nine beam locations designated as A through I. The sum and difference beam patterns 31 and 33 are produced at the nine different locations by exciting different combinations of antenna elements 21–25. In particular, the antenna array 10 produces sum and difference beam patterns 31 and 33 at locations A through C when antenna elements 21 through 23 are excited, at beam locations D through F when antenna elements 21 through 25 are excited, and at beam locations G through I when antenna elements 23 through 25 are excited.

The antenna elements 21–23 have a V-shaped configuration. As is known in the art, this configuration is provided to reduce the undesirable effects of a phenomenon referred to as beam-coning.

FIG. 3, shows an example of the sum beam pattern 31 and difference beam pattern 33 which are received and processed by the conventional antenna array 10. These beam patterns interrogate each of the nine beam locations to identify aircrafts or other devices which are operating in a region of interest. The use of sum and difference beam patterns such as these to identify and communicate with the aircrafts is well known in the art and is described, for example, in U.S. Pat. No. 4,316,192. This document is hereby incorporated by reference as if set forth fully herein.

The beam forming network 30 of the conventional antenna array 10 is responsible for producing the sum and difference beams patterns 31 and 33 at each of the nine locations A through I. To perform this function, the beam forming network 30 includes a plurality of devices. Specifically, the beam forming network 30 includes four single pole double throw (SP2T) switches 33, eight fixed line length phase shifters 34, four 180° hybrid RF devices 35, five couplers 36, and three single pole triple throw (SP3T) switches 37. A description of how the beam forming network 30 produces the sum and difference patterns at one or more of the nine beam locations is presented below.

The processing begins when the sum beam pattern 31 enters the beam forming network 30 through SP3T 37A, and the difference beam pattern 33 enters through SP3T 37B.

The sum beam pattern 31 is then routed to the coupler 36A. The coupler 36A splits the sum beam pattern 31 such that one component is sent directly to SP2T switch 33B and the other component is sent to the 180° hybrid RF device 35A. The 180° hybrid RF device 35A further splits the sum beam pattern into two components. The first component is sent through phase shifter 34A to SP2T switch 33A, and, the second component is sent through phase shifter 34B to SP3T switch 37C.

The difference beam pattern 33 is routed directly to the 180° hybrid RF device 35A. This device similarly splits the difference beam pattern 33 into two components. The first component is sent through phase shifter 34A to SP2T switch 33A, and, the second component is sent through phase shifter 34B to SP3T switch 37C.

The sum and difference beam patterns 31 and 33 received at SP2T switches 33A–B and SP3T switch 37C are then routed to antenna elements 21–23 and propagated into space. When these three antenna elements are excited, as indicated above, the sum and difference beam patterns 31 and 33 will be produced at one of the locations A through C.

The exact location of the beam patterns will depend of the settings of the phase shifters 34A–B which adjust the phase of an incoming signal by increments of 45°. For example, the sum and difference beam patterns 31 and 33 will be produced at location A if the phase shifters 34A–B are positioned at a first setting. Similarly, the sum and difference beam patterns 31 and 33 will be produced at location B if the phase shifters 34A–B are positioned at a second setting, and at location C when if the phase shifters 34A–B are positioned at a third setting.

The antenna array 10 shown in FIG. 1 will similarly produce the sum beam pattern 31 and difference beam pattern 33 at the remaining locations D through I depending on the configuration of the of the SP2T switches 33, the phase shifters 34, and the SP3T switches 37. The process for producing sum and difference beam patterns 31 and 33 at these remaining locations is similar to that described above for locations A–C.

The conventional antenna array 10 described above and shown in FIG. 1 does, however, have certain drawbacks. Most notably, the antenna array 10 has a poor performance reliability and a high cost. These undesirable factors are attributable to the fact that the beam forming network 30 of the antenna array 10 uses a large number of components.

In view of these drawbacks, there currently exists a need for an antenna array which has a strong performance reliability and low cost where the beam forming network used by the antenna array has a simplified configuration and uses a small number of components.

OBJECTS AND SUMMARY OF THE INVENTION

It is accordingly an object of the present invention to provide a beam forming network for use in an antenna array that has a simplified configuration.

It is another object of the invention to provide a beam forming network for use in an antenna array that uses a small number if components.

In accordance with the invention, an antenna array for identifying devices operating in a region of interest is disclosed which comprises: an antenna means for transmitting sum and difference beam patterns to five separate beam locations in space; and a beam forming means for receiving, processing and routing the sum and difference beam patterns to the antenna means.

In accordance with another aspect of the invention, the antenna means includes eight individual antenna elements; the sum and difference beam patterns are radiated to beam locations one through two when antenna elements one through four are excited; the sum and difference beam patterns are radiated to beam location three when antenna elements one through eight are excited; and, the sum and difference beam patterns are radiated to beam locations four through five when antenna elements five through eight are excited.

In accordance with still another aspect of the invention, the beam forming means further includes: eight 90° RF hybrid devices, where each of the 90° RF hybrid devices include two inputs and two outputs; eight fixed line length phase shifters, where each of the phase shifters include on input and one output; six single pole double throw switches (SB2T), where each of the SB2T switches includes one stationary pole and two alternating poles; and, a 180° hybrid RF device which includes two inputs and two outputs.

In accordance with yet another aspect of the invention, the phase shifters are preset to adjust the phase of an incoming signal in increments of 45°.

In accordance with even yet another aspect of the invention, the signal entering a 90° RF hybrid device through the first input with an amplitude of 1 V and a phase of 0° will be split into two output signals, where the first output signal has an amplitude of V and phase of 0° and the second output signal has an amplitude of V and phase of +90°; and a signal entering a 90° RF hybrid device through the second input with an amplitude of 1 V and phase of 0° will be split into two output signals, where the first output signal has an amplitude of V and phase of +90° and the second output signal has an amplitude of V and phase of 0°.

In accordance with still yet another aspect of the invention, a signal entering a 180° RF hybrid device through the first input with an amplitude of 1 V and a phase of 0° will be split into two output signals, where the first output signal has an amplitude of V and phase of 0° and the second output signal has an amplitude of V and phase of 0°; and a signal entering a 180° RF hybrid device through the second input with an amplitude of 1 V and phase of 0° will be split into two output signals, where the first output signal has an amplitude of V and phase of 0° and the second output signal has an amplitude of V and phase of 180°.

Additionally, in accordance with the invention, a method for identifying a device operating in a region of interest is disclosed, where the method comprises the steps of: (1) routing sum and difference beam patterns to a beam forming means; (2) processing the sum and difference beams at the beam forming network to form up to eight output sum and difference beam patterns; (3) routing the output sum and difference beam patterns to a plurality of antenna elements; and (4) transmitting the output sum and difference beam patterns to five separate beam locations in space.

In accordance with another aspect of this invention, step (2) further includes the steps of: (i) routing the sum and difference beam patterns to a 180° hybrid RF device; (ii) routing the sum and difference beam patterns from step (i) through at least one single pole double throw switch (SB2T); (iii) routing the sum and difference beam patterns from step (ii) through at least one fixed line length phase shifter; (iv) routing the sum and difference beam patterns from step (iii) though a plurality of 90° RF hybrid devices.

In accordance with even another aspect of this invention: the plurality of antenna elements includes eight individual antenna elements; the sum and difference beam patterns are radiated to beam locations one through two when antenna elements one through four are excited; the sum and difference beam patterns are radiated to beam location three when antenna elements one through eight are excited; and; the sum and difference beam patterns are radiated to beam locations four through five when antenna elements five through eight are excited.

In accordance with still another aspect of this invention, the beam forming network comprises: eight 90° RF hybrid devices, where each of the 90° RF hybrid devices include two inputs and two outputs; eight fixed line length phase shifters, where each of the phase shifters include on input and one output; six single pole double throw switches (SB2T), where each of the SB2T switches includes one stationary pole and two alternating poles; and, a 180° hybrid RF device which includes two inputs and two outputs.

In accordance with still another aspect of this invention, the phase shifters are preset to adjust the phase of an incoming signal in increments of 45°.

In accordance with still yet another aspect of this invention, a signal entering a 90° RF hybrid device through the first input with an amplitude of 1 V and a phase of 0° will be split into two output signals, where the first output signal has an amplitude of V and phase of 0° and the second output signal has an amplitude of V and phase of +90°; and a signal entering a 90° RF hybrid device through the second input with an amplitude of 1 V and phase of 0° will be split into two output signals, where the first output signal has an amplitude of V and phase of +90° and the second output signal has an amplitude of V and phase of 0°.

In accordance with another aspect of this invention, a signal entering a 180° RF hybrid device through the first input with an amplitude of 1 V and a phase of 0° will be split into two output signals, where the first output signal has an amplitude of V and phase of 0° and the second output signal has an amplitude of V and phase of 0°; and a signal entering a 180° RF hybrid device through the second input with an amplitude of 1 V and phase of 0° will be split into two output signals, where the first output signal has an amplitude of V and phase of 0° and the second output signal has an amplitude of V and phase of 180°.

BRIEF DESCRIPTION OF THE DRAWINGS

The accompanying drawings are included to provide an understanding of the invention and constitute a part of the specification.

FIG. 9 illustrates a chart which shows the signal characteristics for the sum beam pattern shown in FIG. 7 and the difference beam pattern shown in FIG. 8, when processed by the beam forming network shown in FIG. 4;

FIG. 13 illustrates a chart which shows the signal characteristics for the sum beam pattern shown in FIG. 11 and the difference beam pattern shown in FIG. 12, when processed by the beam forming network shown in FIG. 10;

FIG. 17 illustrates a chart which shows the signal characteristics for the sum beam pattern shown in FIG. 15 and the difference beam pattern shown in FIG. 16, when processed by the beam forming network shown in FIG. 14;

FIG. 21 illustrates a chart which shows the signal characteristics for the sum beam pattern shown in FIG. 19 and the difference beam pattern shown in FIG. 20, when processed by the beam forming network shown in FIG. 18;

FIG. 25 is a chart which shows the signal characteristics for the sum beam pattern shown in FIG. 23 and the difference beam pattern shown in FIG. 24, when processed by the beam forming network shown in FIG. 22;

DETAILED DESCRIPTION OF THE INVENTION

Figure 1:
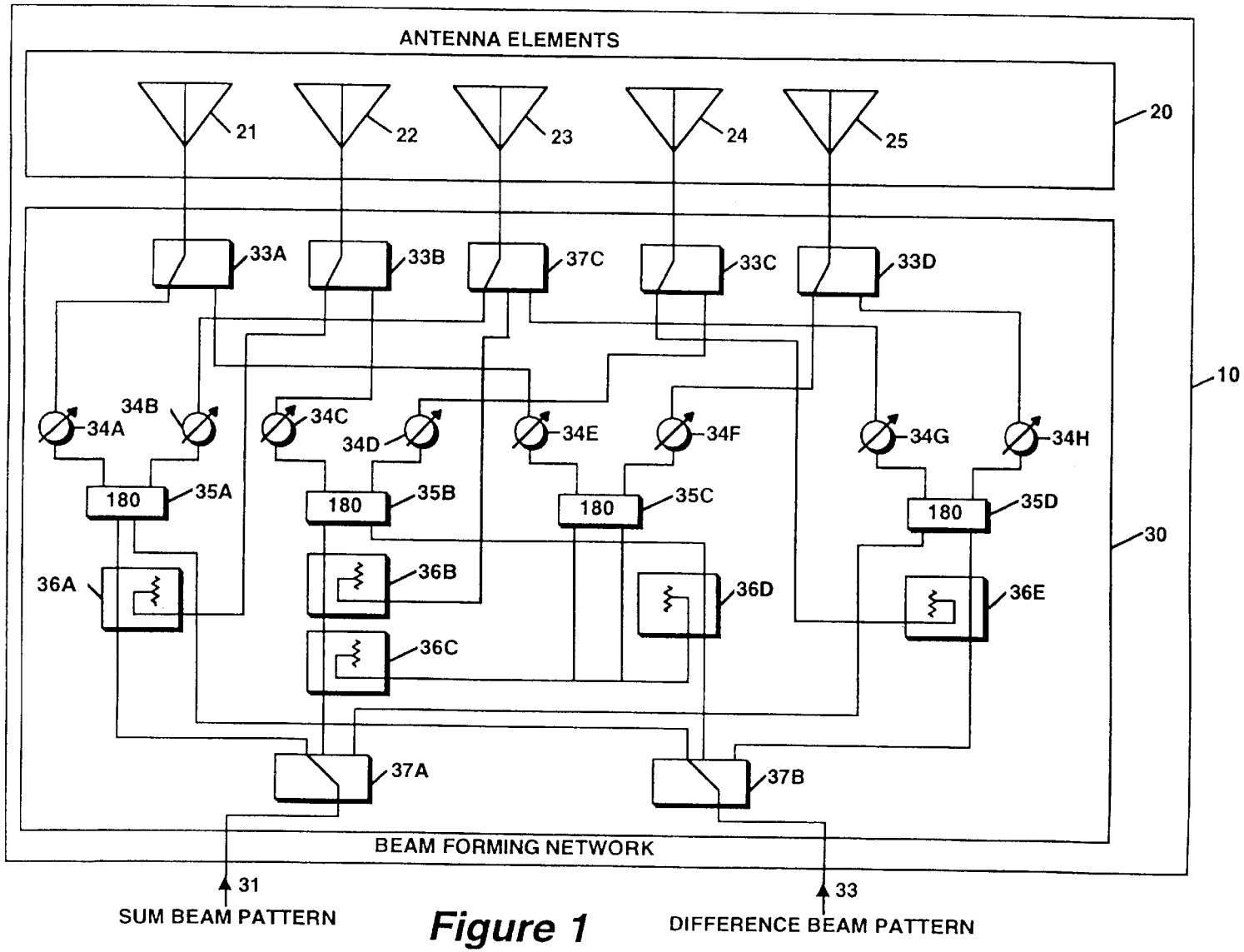
FIG. 1 illustrates a conventional antenna array.
Figure 2:
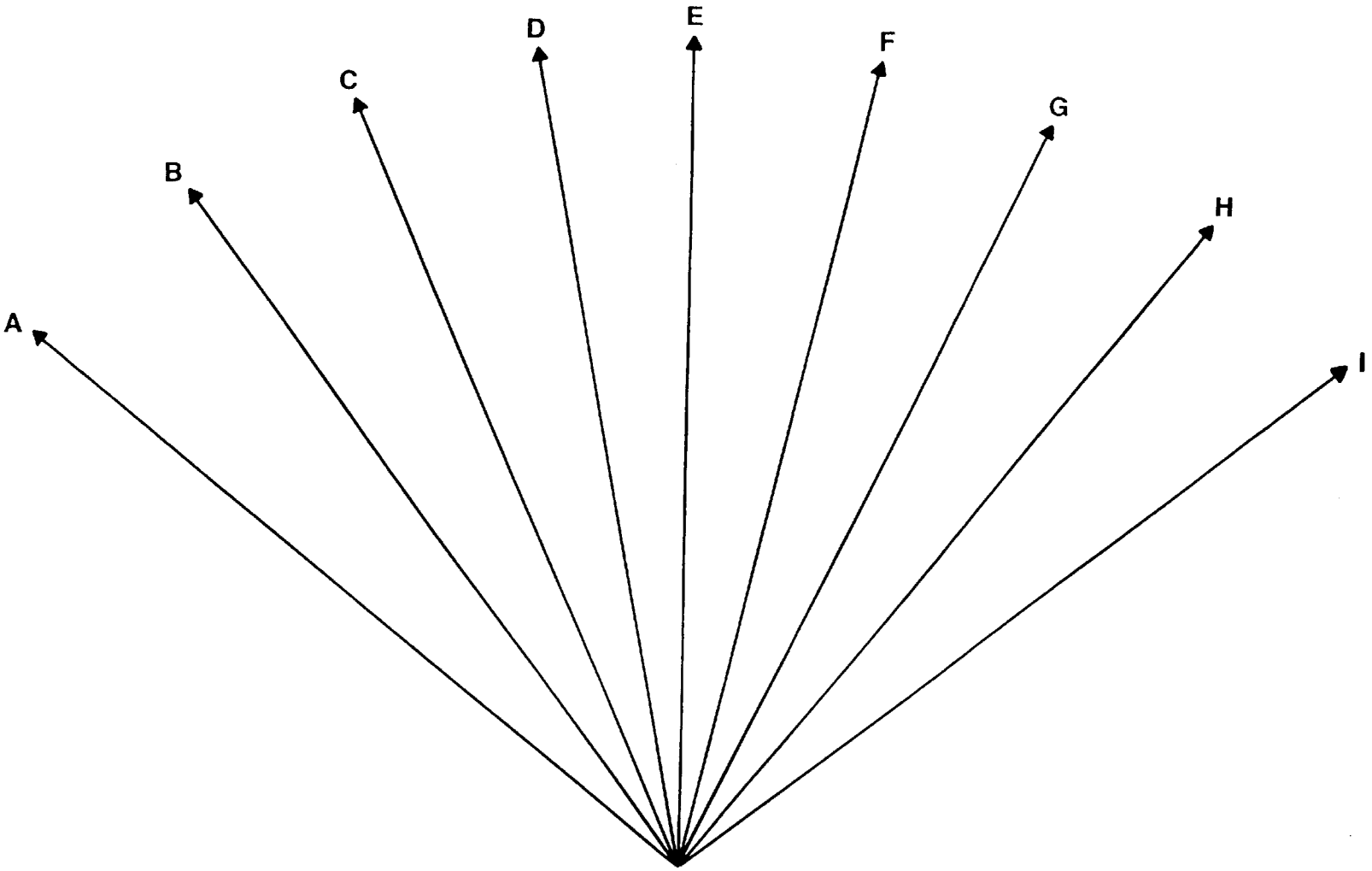
FIG. 2 illustrates nine separate beam locations A through I interrogated by the conventional antenna array shown in FIG. 1.
Figure 3:
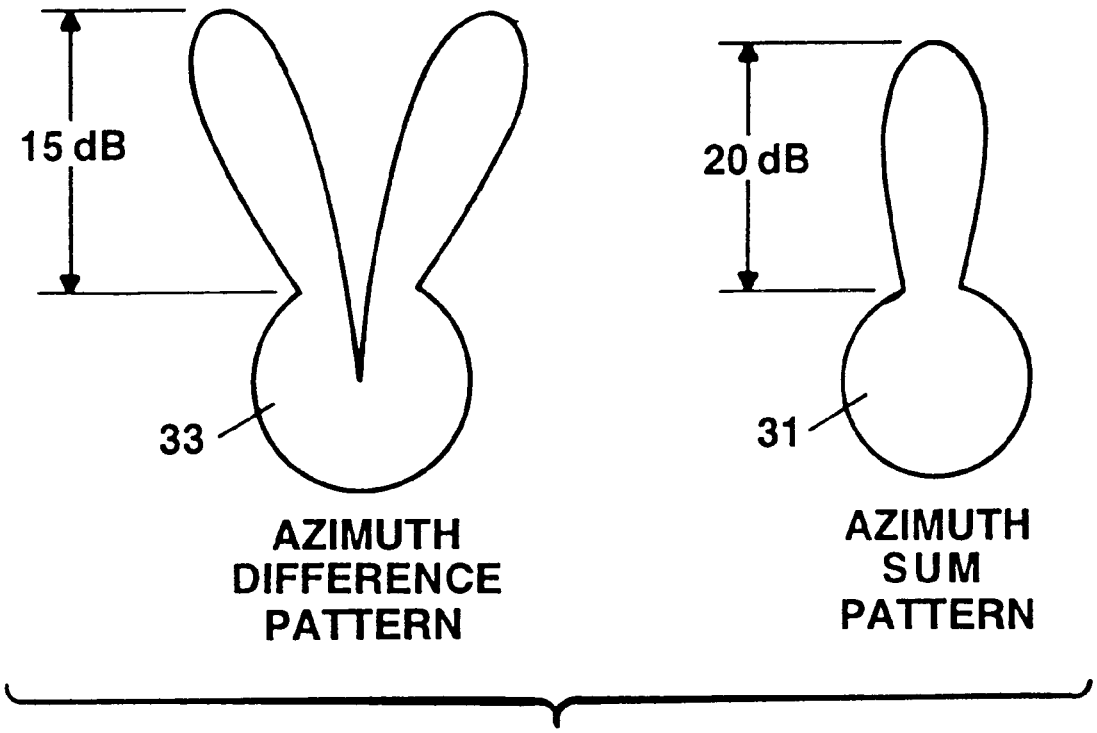
FIG. 3 illustrates sum and difference beam patterns used by the conventional antenna array shown in FIG. 1.
Figure 4:
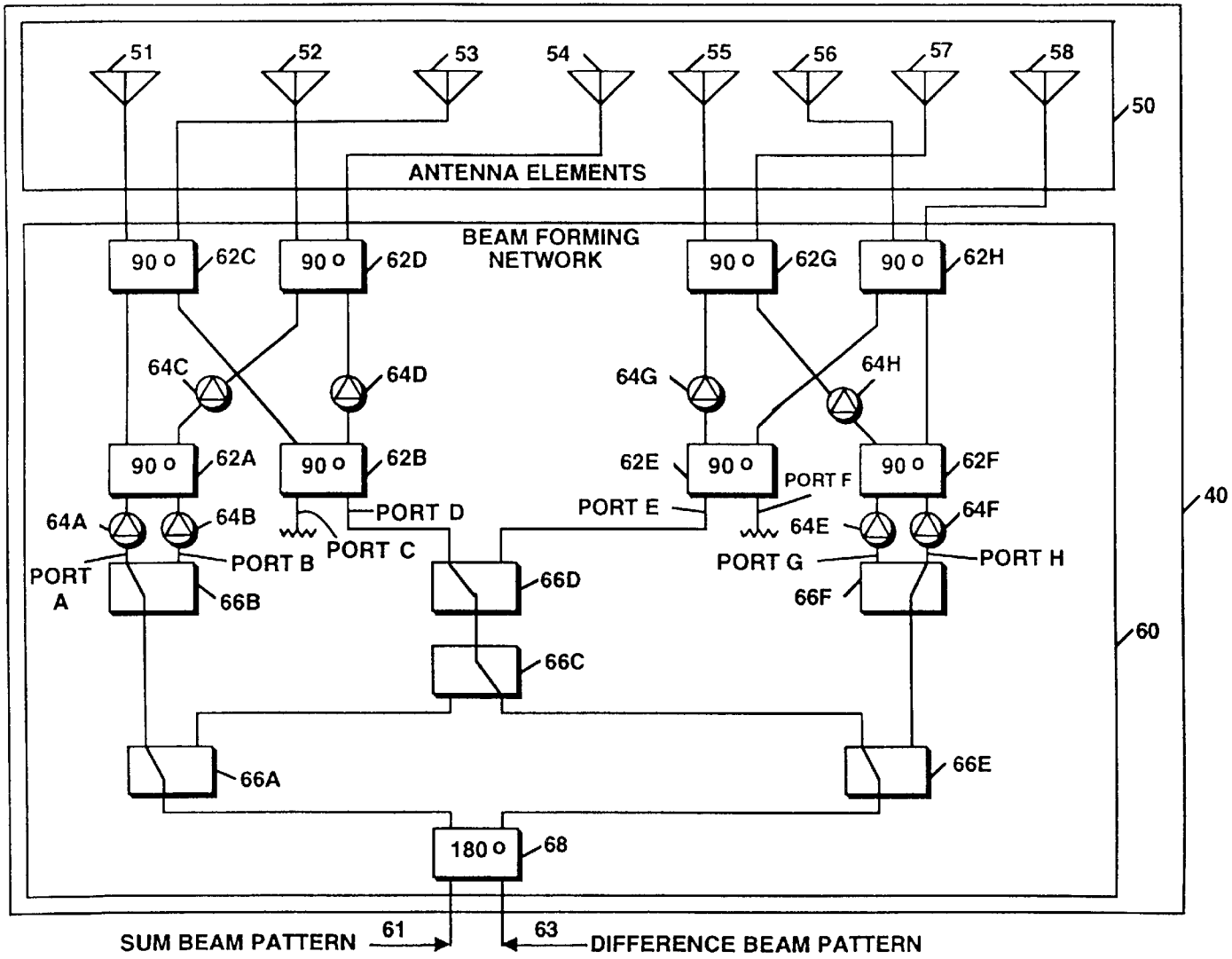
FIG. 4 illustrates an antenna array using a simplified beam forming network developed in accordance with the present invention.

FIG. 4 shows an antenna array 40 which was developed in accordance with the present invention. The antenna 40 includes an antenna component 50 and a beam forming network 60. The antenna component 50 includes eight individual antenna elements 51–58, where, the beam forming network 60 includes a minimal amount hardware to receive, process and route a sum beam pattern 61 and a difference beam pattern 63 to the antenna component 50.

Figure 5:
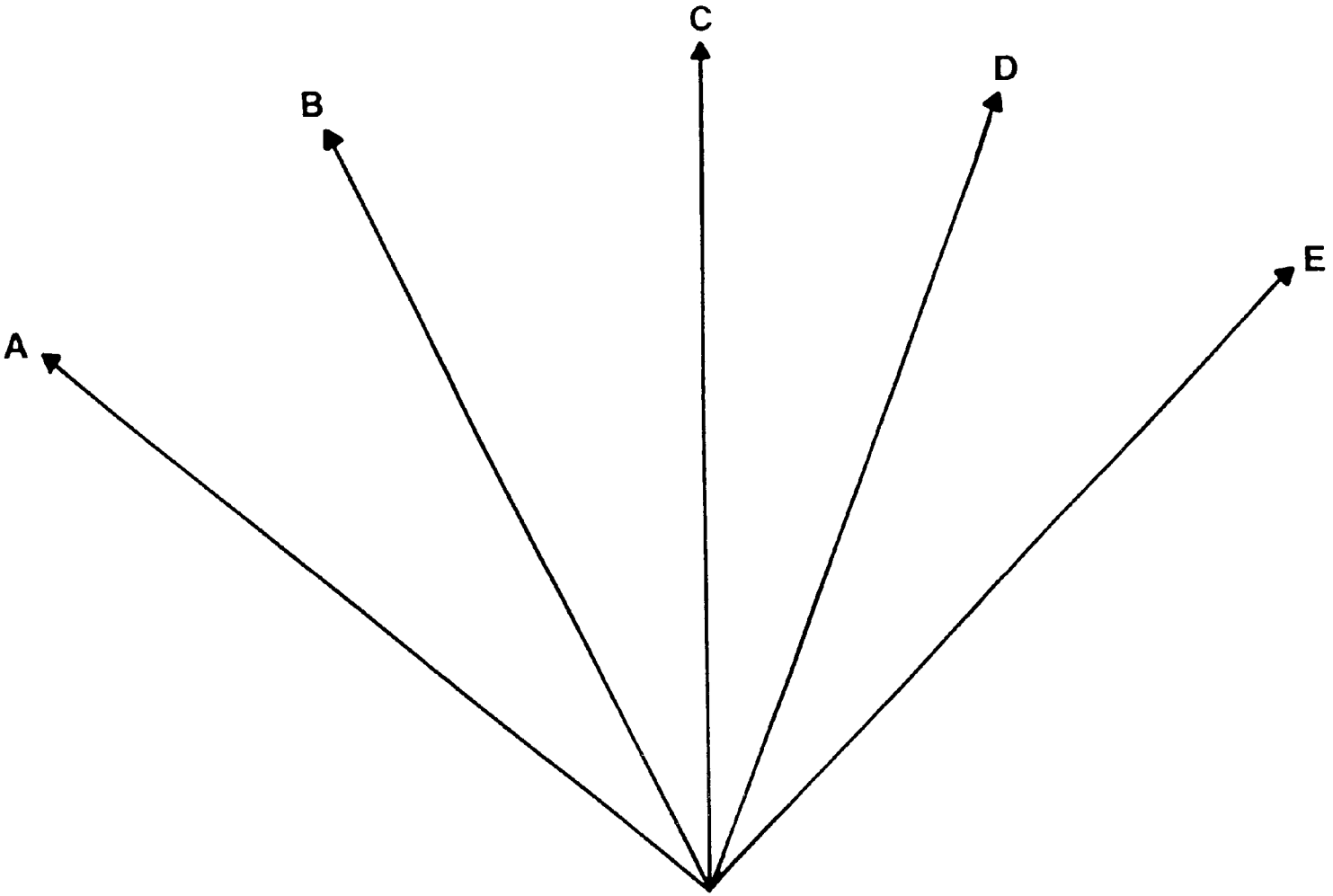
FIG. 5 illustrates five separate beam locations A through E which are interrogated by an antenna array developed in accordance with the present invention.

The antenna 40 developed in accordance with the present inventions as shown in FIG. 5, radiates sum and difference beam patterns 61 and 63 to five separate beam locations. Each of these five beam locations are designated by letters A through E. Operationally, the antenna 40 produces the sum beam pattern 61 and difference beam pattern 63 at locations A and B by exciting antenna elements 51 through 54. Similarly, by exciting antenna elements 51 through 58, the antenna 40 produces sum and difference beam patterns at location C, and by exciting antenna elements 55 through 58 the antenna 40 produces sum and difference patterns at beam locations D and E.

Figure 6:
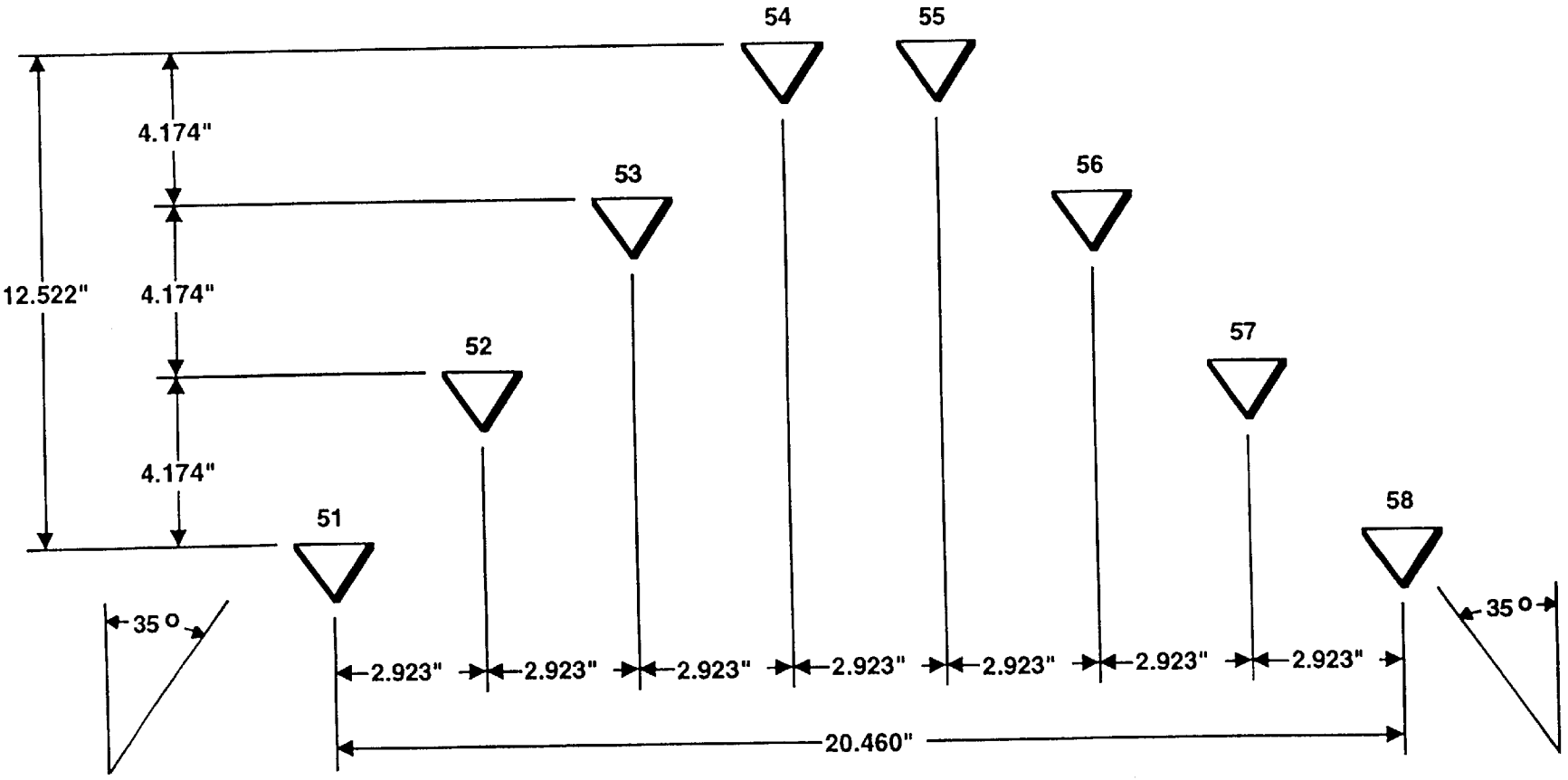
FIG. 6 illustrates the exact configuration and measurements of antenna elements used by an antenna array developed in accordance with the present invention.

The exact configuration and measurements of the antenna elements 51 through 58 is shown in FIG. 6. As shown in this drawing, the antenna elements 51 through 58 positioned in the shape of a triangle, where the left and right sides of the triangle are slanted inwardly at an angle of 35°.

The beam forming network 60 developed in accordance with the present invention, unlike the beam forming network used with the conventional antenna, contains a minimal number of devices. Specifically, as shown in FIG. 4, the beam forming network 60 only contains eight 90° RF hybrid devices 62, eight fixed line length phase shifters 64, six single pole double throw switches (SB2T) 66, and one 180° hybrid RF device 68.

A description of how the beam forming network 60 produces sum and difference beam patterns 61 and 63 at beam locations A through E in accordance with the present invention is described in detail below.

BEAM LOCATION A

Figure 7:
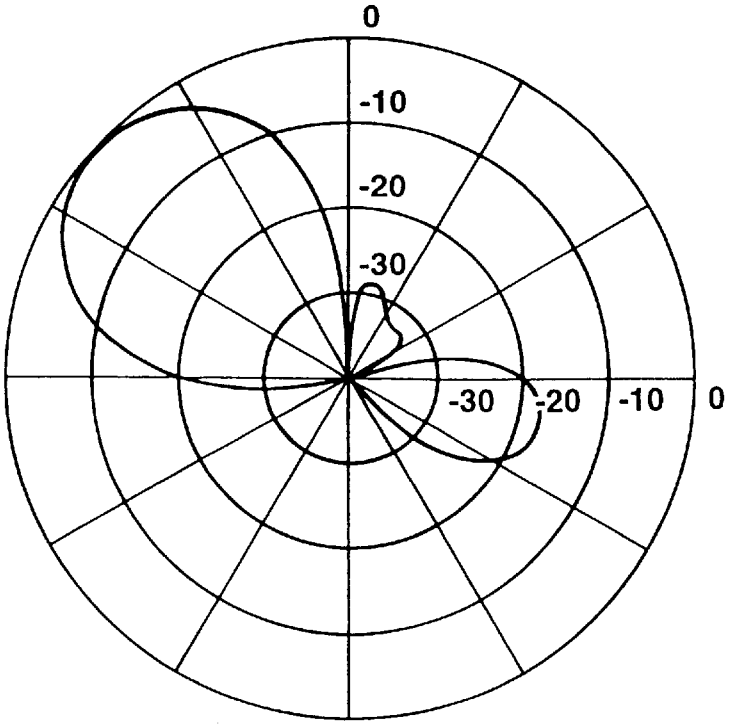
FIG. 7 illustrates a sum beam pattern used with an antenna array developed in accordance with present invention, when the beam network is configured as shown in FIG. 4.
Figure 8:
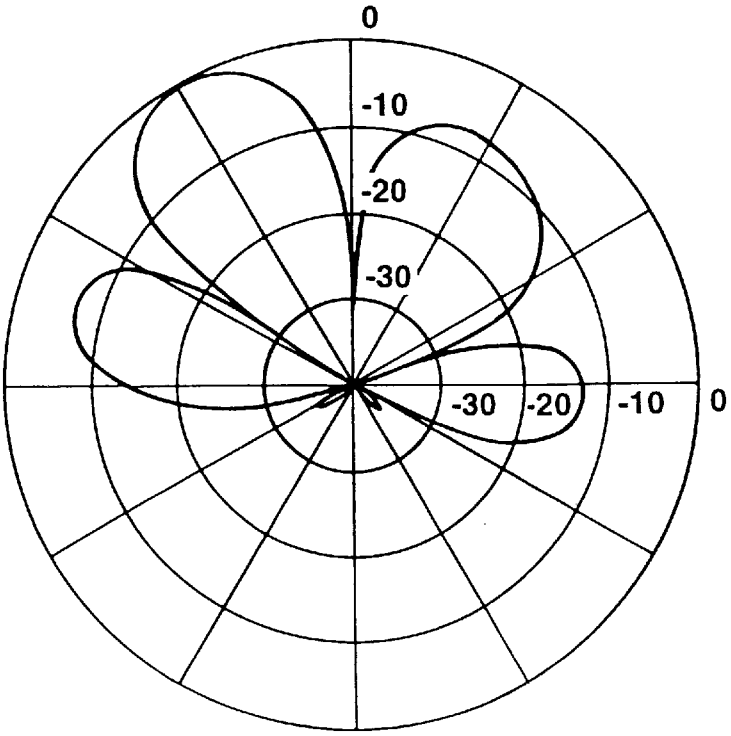
FIG. 8 illustrates a difference beam pattern used with an antenna array developed in accordance with present invention, when the beam forming network is configured as shown in FIG. 4.

FIG. 4 shows the beam forming network 60 when configured to produce sum and difference beam patterns 61 and 63 at beam location A. A depiction of the sum beam pattern 61 used with this configuration is shown in FIG. 7, whereas, a depiction of the difference beam pattern 63 used with the configuration is shown in FIG. 8.

The sum beam pattern 61 is first routed to the 180° hybrid RF device 68. This device splits the sum beam pattern 61 into two component signals.

The first component signal is sent to SP2T switch 66A, then to SP2T switch 66B, through Port A, through phase shifter 64A, and then to a 90° hybrid RF device 62A. The 90° hybrid RF device 62A further splits the first component signal into a first—first component signal and a first-second component signal. The first—first component signal is sent to 90° hybrid RF device 62C for further splitting and routing to antenna elements 51 and 53. The first-second component signal is sent through phase shifter 64C and to 90° hybrid RF device 62D for further splitting and routing to antenna elements 52 and 54.

The second component signal of the sum beam pattern 61 produced by the 180° hybrid RF device 68 is alternatively sent to SP2T switch 66E. This signal is then sent to SP2T switch 66C, then to SP2T switch 66D, through Port D, and then to the 90° hybrid RF device 62B. The 90° hybrid RF device 62B further splits the second component signal into a second-first component signal and a second—second component signal. The second-first component signal is sent to 90° hybrid RF device 62C for further splitting and routing to antenna elements 51 and 53. The second—second component signal is sent through phase shifter 64D and to 90° hybrid RF device 62D for further splitting and routing to antenna elements 52 and 54.

The difference beam pattern 63 is also routed to the 180° hybrid RF device 68. This device again splits the difference beam pattern 63 into two component signals. These two component signals are processed in a manner similar to the two component signals for the sum beam pattern 61 described above for beam location A.

FIG. 9 shows the signal characteristics for both the sum beam pattern 61 and difference beam pattern 63 produced by the beam forming network shown in FIG. 4. In particular, referring to the fourth column of the two charts shown on FIG. 9, the resultant signals produced at elements 51–58 by the beam forming network have an amplitude (dB) and phase (deg) that will result in the sum beam pattern 61 and the difference beam pattern 63 being produced at beam location A.

BEAM LOCATION B

Figure 10:
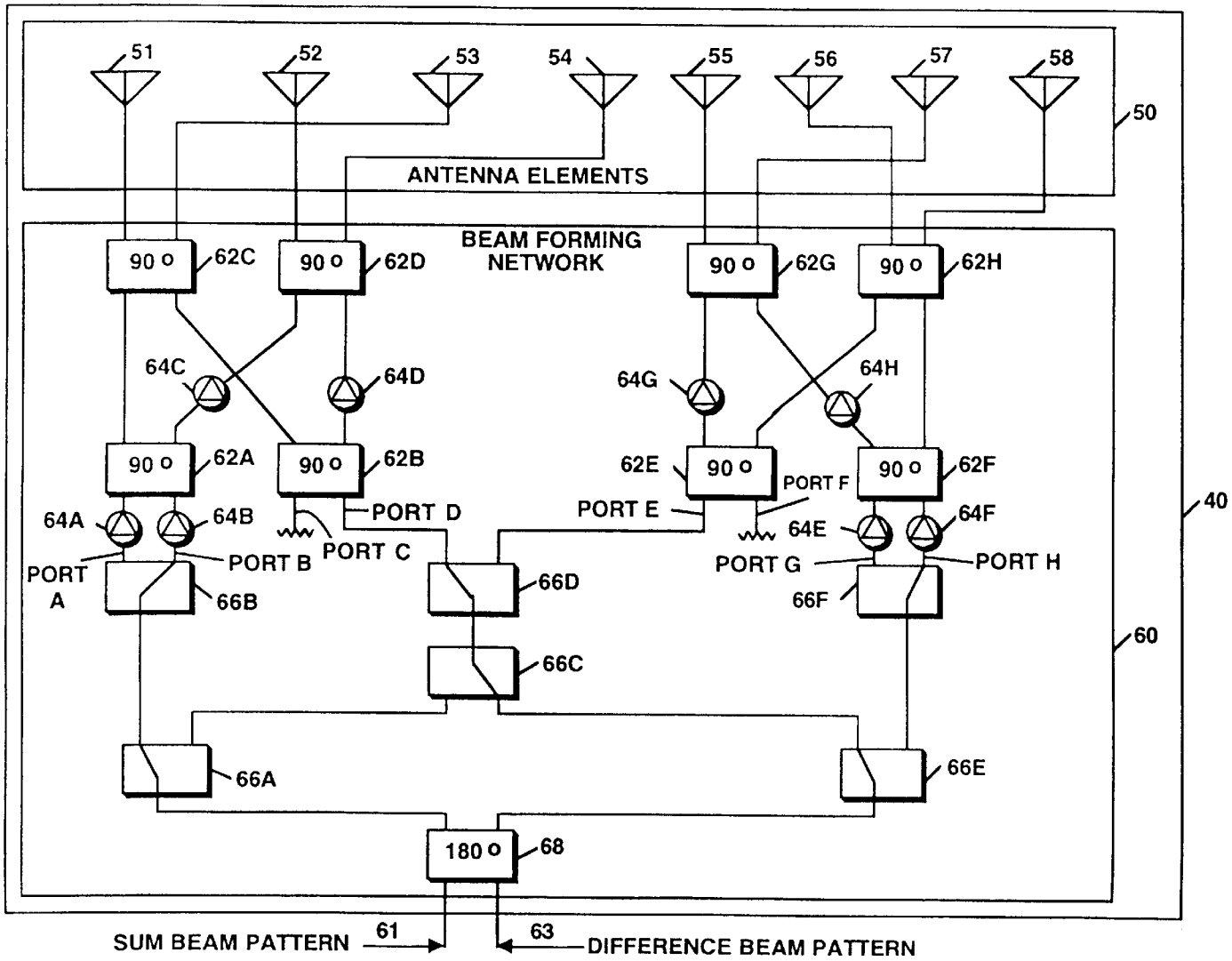
FIG. 10 illustrates an antenna array developed in accordance with the present invention with a simplified beam forming network that is configured to interrogate beam location B.
Figure 11:
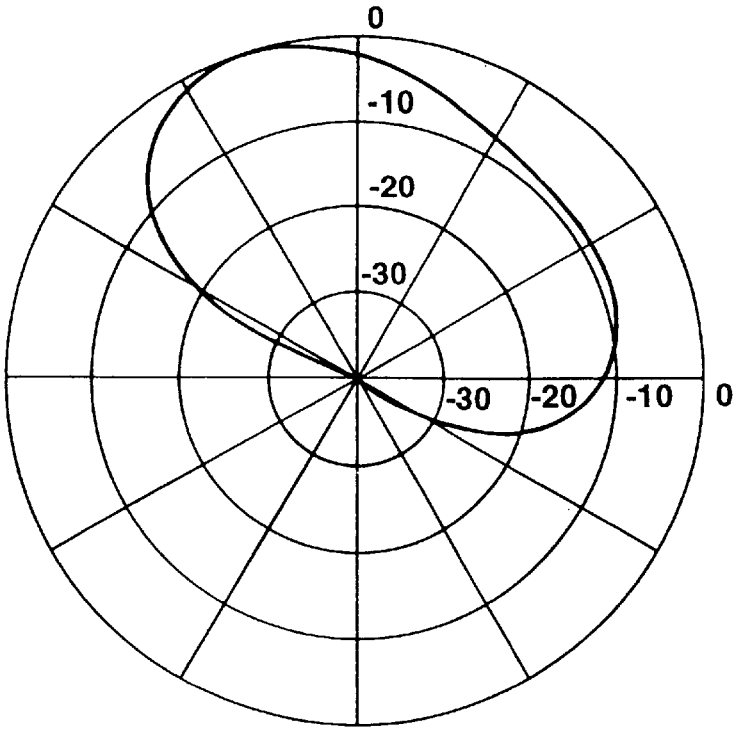
FIG. 11 illustrates a sum beam pattern used with an antenna array developed in accordance with present invention, when the beam forming network is configured as shown in FIG. 10.
Figure 12:
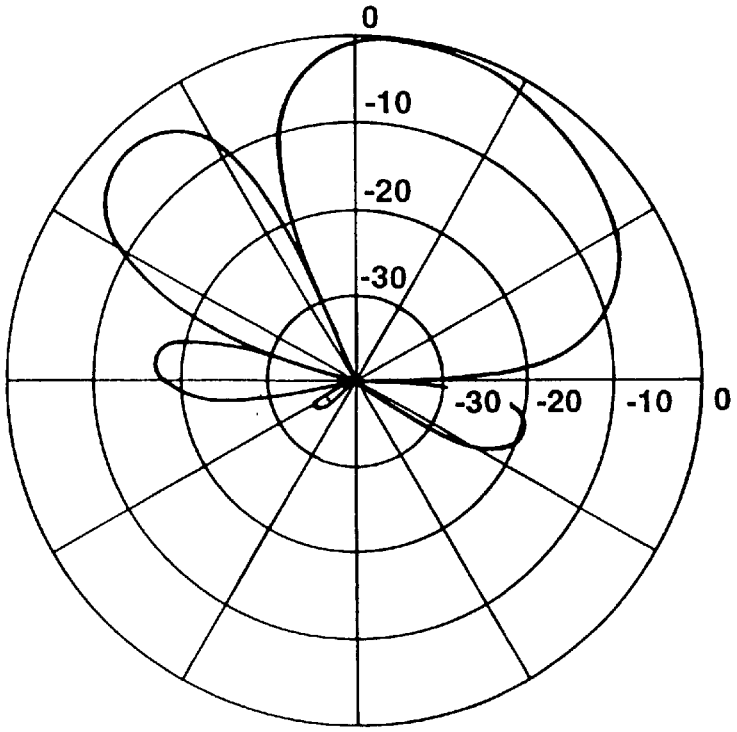
FIG. 12 illustrates a difference beam pattern used with an antenna array developed in accordance with present invention, when the beam forming network is configured as shown in FIG. 10.

FIG. 10 shows the beam forming network 60 when configured to produce sum and difference beam patterns 61 and 63 at beam location B. A depiction of the sum beam pattern 61 used with this configuration is shown in FIG. 11, whereas, a depiction of the difference beam pattern 63 used with the configuration is shown in FIG. 12.

The sum beam pattern 61 is first routed to the 180° hybrid RF device 68. This device splits the sum beam pattern 61 into two component signals.

The first component signal is sent to SP2T switch 66A, then to SP2T switch 66B, through Port B, through phase shifter 64B, and then to a 90° hybrid RF device 62A. The 90° hybrid RF device 62A further splits the first component signal into a first—first component signal and a first-second component signal. The first—first component signal is sent to 90° hybrid RF device 62C for further splitting and routing to antenna elements 51 and 53. The first-second component signal is sent through phase shifter 64C and to 90° hybrid RF device 62D for further splitting and routing to antenna elements 52 and 54.

The second component signal of the sum beam pattern 61 produced by the 180° hybrid RF device 68 is alternatively sent to SP2T switch 66E. This signal is then sent to SP2T switch 66C, then to SP2T switch 66D, through Port D, and then to the 90° hybrid RF device 62B. The 90° hybrid RF device 62B further splits the second component signal into a second-first component signal and a second—second component signal. The second-first component signal is sent to 90° hybrid RF device 62C for further splitting and routing to antenna elements 51 and 53. The second—second component signal is sent through phase shifter 64D and to 90° hybrid RF device 62D for further splitting and routing to antenna elements 52 and 54.

The difference beam pattern 63 is also routed to the 180° hybrid RF device 68. This device again splits the difference beam pattern 63 into two component signals. These two component signals are processed in a manner similar to the two component signals for the sum beam pattern 61 described above for beam location B.

FIG. 13 shows the signal characteristics for both the sum beam pattern 61 and difference beam pattern 63 produced by the beam forming network shown in FIG. 10. In particular, referring to the fourth column of the two charts shown on FIG. 13, the resultant signals produced at elements 51–58 by the beam forming network have an amplitude (dB) and phase (deg) that will result in the sum beam pattern 61 and the difference beam pattern 63 being produced at beam location B.

BEAM LOCATION C

Figure 14:
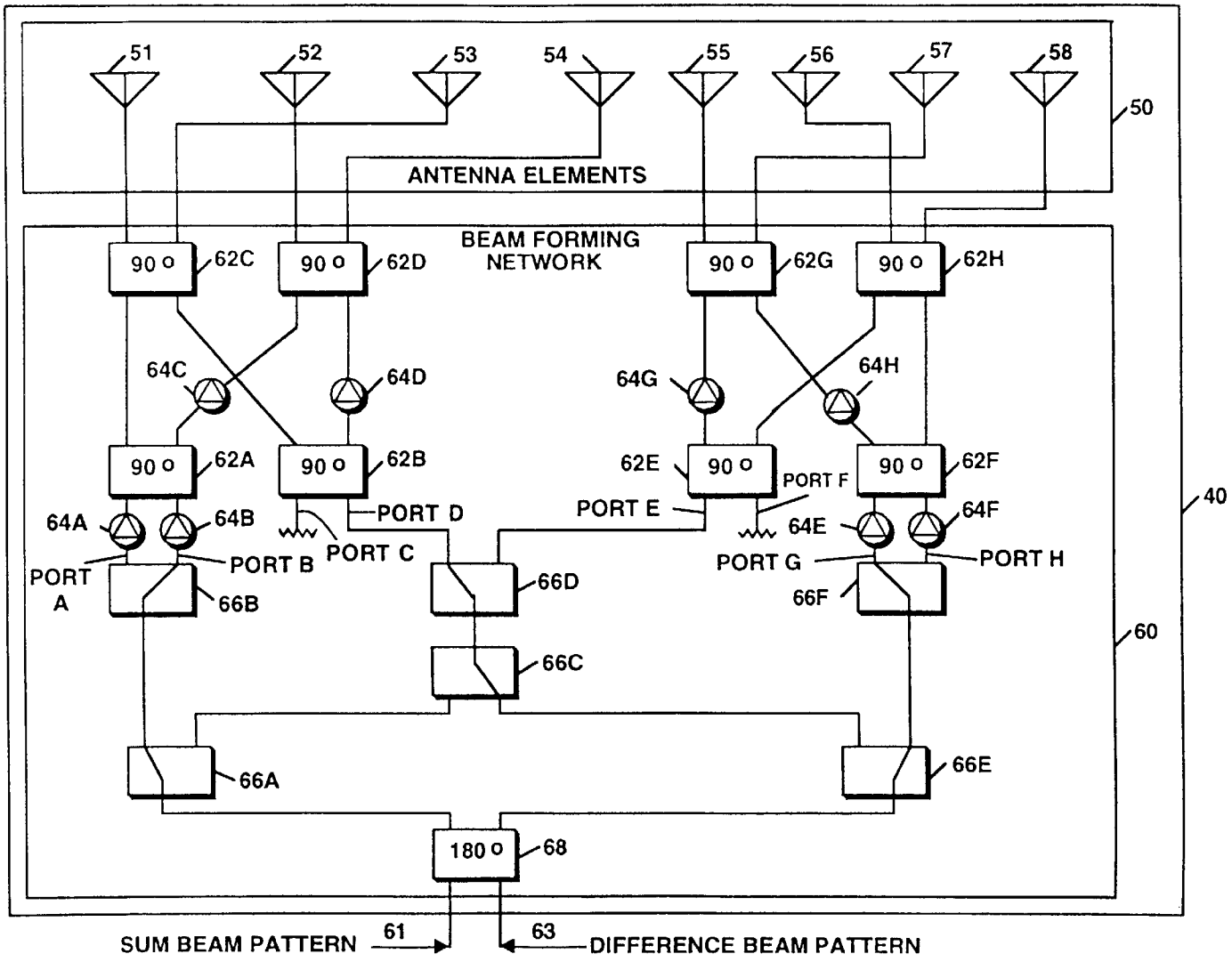
FIG. 14 illustrates an antenna array developed in accordance with the present invention with a simplified beam forming network that is configured to interrogate beam location C.
Figure 15:
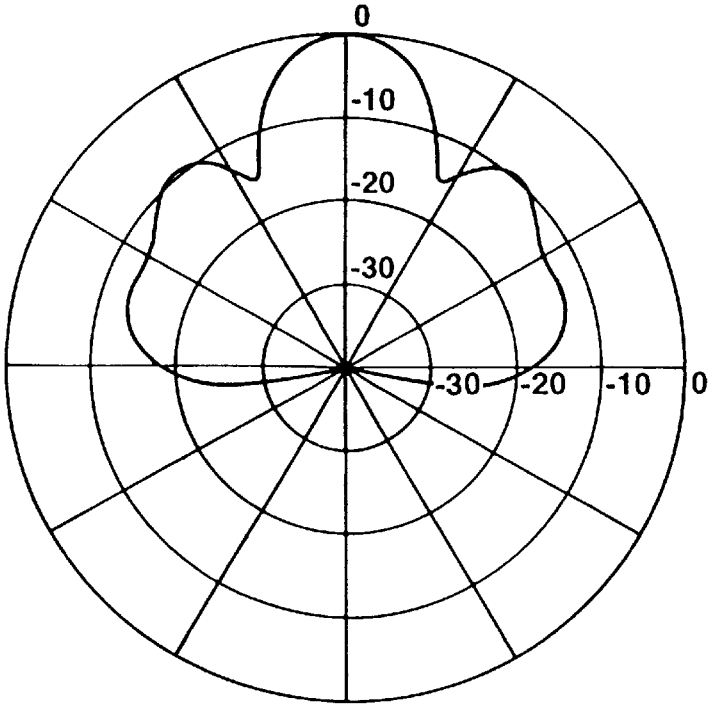
FIG. 15 illustrates a sum beam pattern used with an antenna array developed in accordance with present invention, when the beam forming network is configured as shown in FIG. 14.
Figure 16:
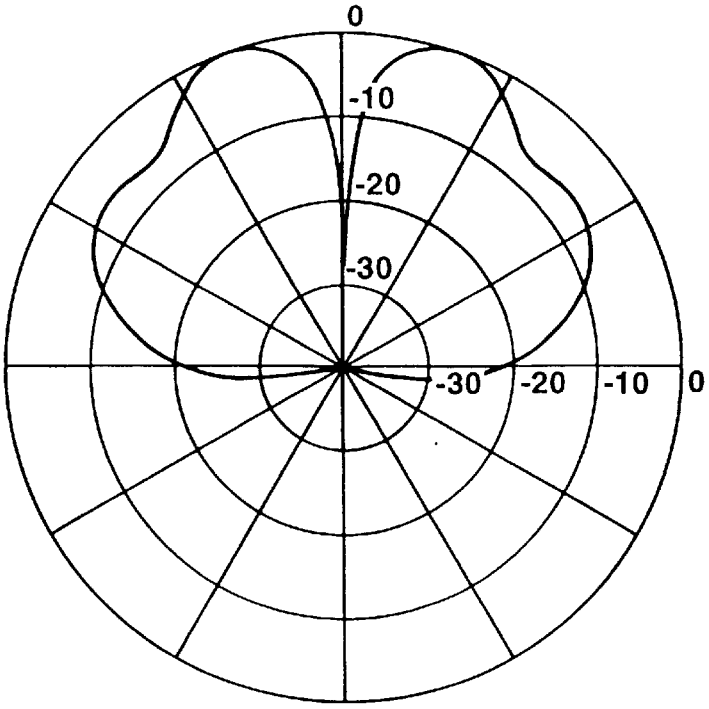
FIG. 16 illustrates a difference beam pattern used with an antenna array developed in accordance with present invention, when the beam forming network is configured as shown in FIG. 14.

FIG. 14 shows the beam forming network 60 when configured to produce sum and difference beam patterns 61 and 63 at beam location C. A depiction of the sum beam pattern 61 used with this configuration is shown in FIG. 15, whereas, a depiction of the difference beam pattern 63 used with the configuration is shown in FIG. 16.

The sum beam pattern 61 is first routed to the 180° hybrid RF device 68. This device splits the sum beam pattern 61 into two component signals.

The first component signal is sent to SP2T switch 66A, then to SP2T switch 66B, through Port B, through phase shifter 64B, and then to a 90° hybrid RF device 62A. The 90° hybrid RF device 62A further splits the first component signal into a first—first component signal and a first-second component signal. The first—first component signal is sent to 90° hybrid RF device 62C for further splitting and routing to antenna elements 51 and 53. The first-second component signal is sent through phase shifter 64C and to 90° hybrid RF device 62D for further splitting and routing to antenna elements 52 and 54.

The second component signal of the sum beam pattern 61 produced by the 180° hybrid RF device 68 is alternatively sent to SP2T switch 66E. This signal is then sent to SP2T switch 66F, through Port G, through phase shifter 64E, and then to the 90° hybrid RF device 62F. The 90° hybrid RF device 62F further splits the second component signal into a second-first component signal and a second—second component signal. The second-first component signal is sent through phase shifter 64H and then to 90° hybrid RF device 62G for further splitting and routing to antenna elements 55 and 57. The second—second component signal is sent to 90° hybrid RF device 62H for further splitting and routing to antenna elements 56 and 58.

The difference beam pattern 63 is also routed to the 180° hybrid RF device 68. This device again splits the difference beam pattern 63 into two component signals. These two component signals are processed in a manner similar to the two component signals for the sum beam pattern 61 described above for beam location C.

FIG. 17 shows the signal characteristics for both the sum beam pattern 61 and difference beam pattern 63 produced by the beam forming network shown in FIG. 14. In particular, referring to the fourth column of the two charts shown on FIG. 17, the resultant signals produced at elements 51–58 by the beam forming network have an amplitude (dB) and phase (deg) that will result in the sum beam pattern 61 and the difference beam pattern 63 being produced at beam location C.

BEAM LOCATION D

Figure 18:
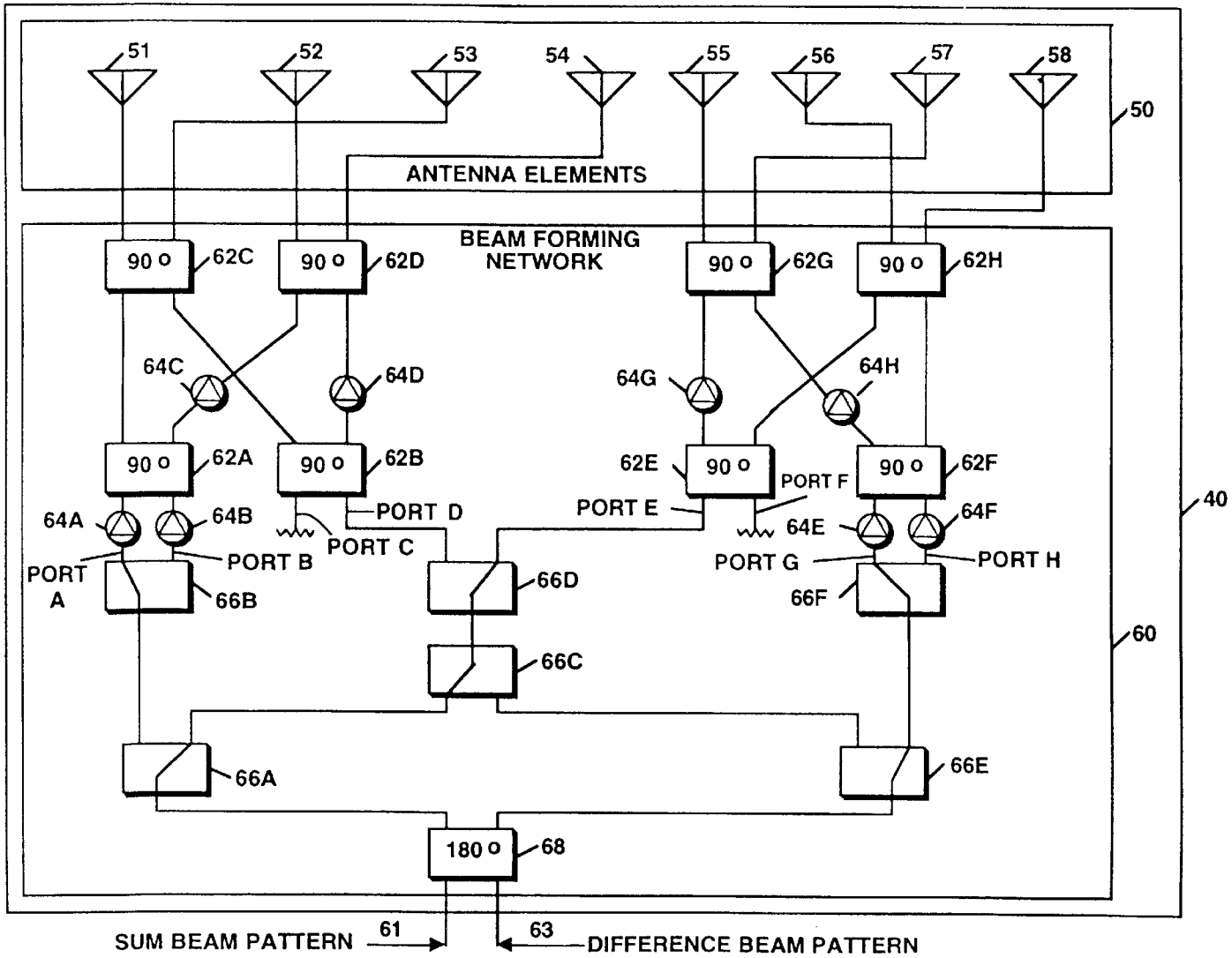
FIG. 18 illustrates an antenna array developed in accordance with the present invention with a beam forming network that is configured to interrogate beam location D.
Figure 19:
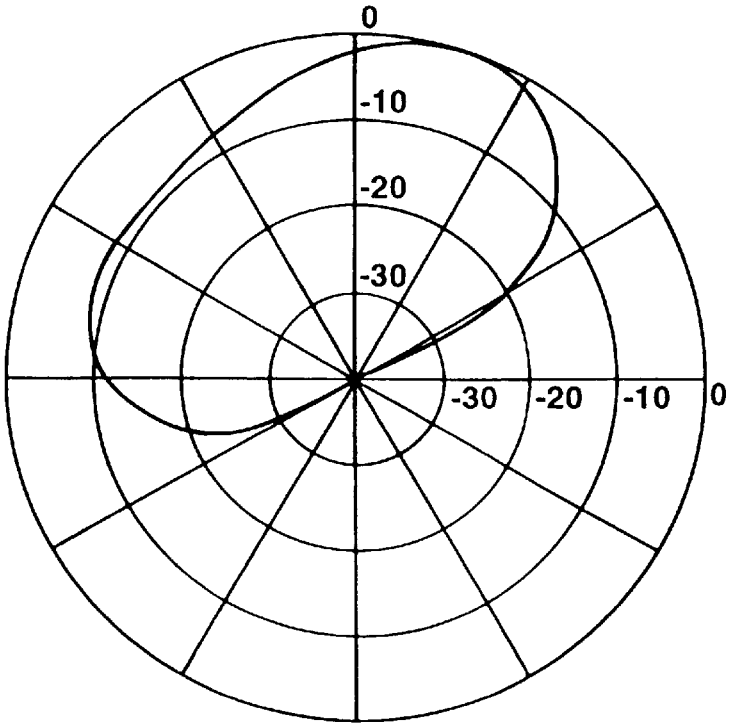
FIG. 19 illustrates a sum beam pattern used with an antenna array developed in accordance with present invention, when the beam forming network is configured as shown in FIG. 18.
Figure 20:
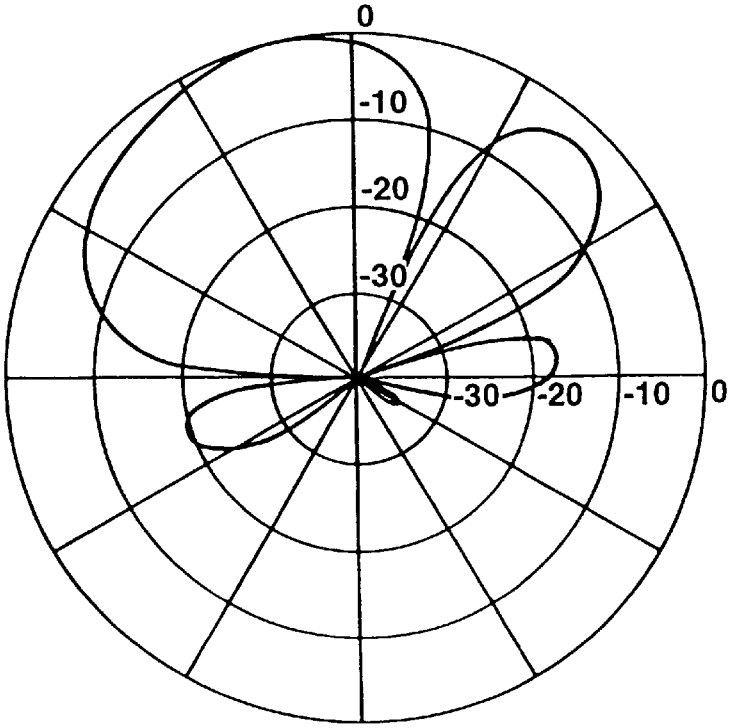
FIG. 20 illustrates a difference beam pattern used with an antenna array developed in accordance with present invention, when the beam forming network is configured as shown in FIG. 18.

FIG. 18 shows the beam forming network 60 when configured to produce sum and difference beam patterns 61 and 63 at beam location D. A depiction of the sum beam pattern 61 used with this configuration is shown in FIG. 19, whereas, a depiction of the difference beam pattern 63 used with the configuration is shown in FIG. 20.

The sum beam pattern 61 is first routed to the 180° hybrid RF device 68. This device splits the sum beam pattern 61 into two component signals.

The first component signal is sent to SP2T switch 66A, then to SP2T switch 66C, then to SP2T switch 66D, through Port E, and then to a 90° hybrid RF device 62E. The 90° hybrid RF device 62E further splits the first component signal into a first—first component signal and a first-second component signal. The first—first component signal is sent through phase shifter 64G and to 90° hybrid RF device 62G for further splitting and routing to antenna elements 55 and 57. The first-second component signal is sent to 90° hybrid RF device 62H for further splitting and routing to antenna elements 56 and 58.

The second component signal of the sum beam pattern 61 produced by the 180° hybrid RF device 68 is alternatively sent to SP2T switch 66E. This signal is then sent to SP2T switch 66F, through Port G, through phase shifter 64E, and then to the 90° hybrid RF device 62F. The 90° hybrid RF device 62F further splits the second component signal into a second-first component signal and a second—second component signal. The second-first component signal is sent through phase shifter 64H and then to 90° hybrid RF device 62G for further splitting and routing to antenna elements 55 and 57. The second—second component signal is sent to 90° hybrid RF device 62H for further splitting and routing to antenna elements 56 and 58.

The difference beam pattern 63 is also routed to the 180° hybrid RF device 68. This device again splits the difference beam pattern 63 into two component signals. These two component signals are processed in a manner similar to the two component signals for the sum beam pattern 61 described above for beam location D.

FIG. 21 shows the signal characteristics for both the sum beam pattern 61 and difference beam pattern 63 produced by the beam forming network shown in FIG. 18. In particular, referring to the fourth column of the two charts shown on FIG. 21, the resultant signals produced at elements 51–58 by the beam forming network have an amplitude (dB) and phase (deg) that will result in the sum beam pattern 61 and the difference beam pattern 63 being produced at beam location D.

BEAM LOCATION E

Figure 22:
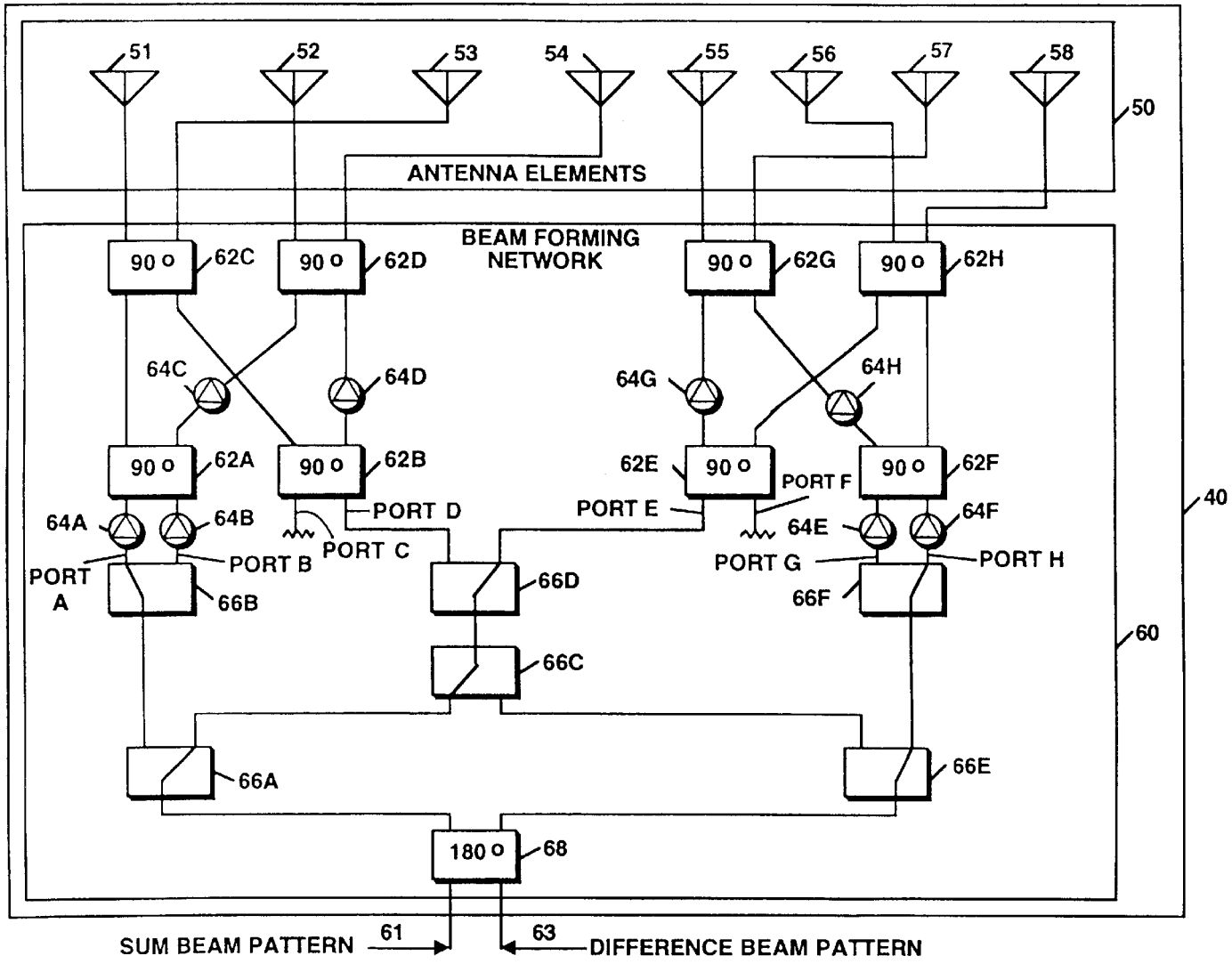
FIG. 22 illustrates an antenna array developed in accordance with the present invention with a simplified beam forming network that is configured to interrogate beam location E.
Figure 23:
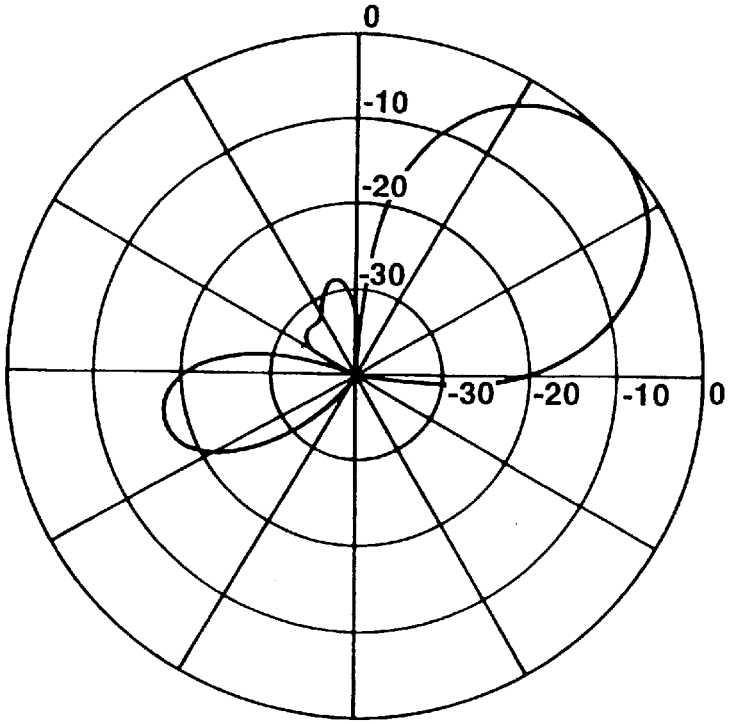
FIG. 23 illustrates a sum beam pattern used with an antenna array developed in accordance with present invention, when the beam forming network is configured as shown in FIG. 22.
Figure 24:
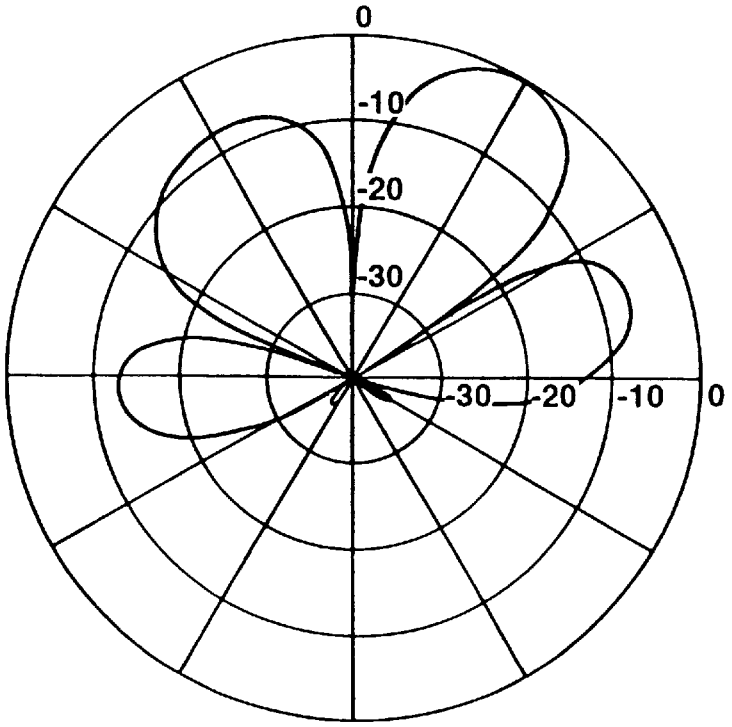
FIG. 24 illustrates a difference beam pattern used with an antenna array developed in accordance with present invention, when the beam forming network is configured as shown in FIG. 22.

FIG. 22 shows the beam forming network 60 when configured to produce sum and difference beam patterns 61 and 63 at beam location E. A depiction of the sum beam pattern 61 used with this configuration is shown in FIG. 23, whereas, a depiction of the difference beam pattern 63 used with the configuration is shown in FIG. 24.

The sum beam pattern 61 is first routed to the 180° hybrid RF device 68. This device splits the sum beam pattern 61 into two component signals.

The first component signal is sent to SP2T switch 66A, then to SP2T switch 66C, then to SP2T switch 66D, through Port E, and then to a 90° hybrid RF device 62E. The 90° hybrid RF device 62E further splits the first component signal into a first—first component signal and a first-second component signal. The first—first component signal is sent through phase shifter 64G and to 90° hybrid RF device 62G for further splitting and routing to antenna elements 55 and 57. The first-second component signal is sent to 90° hybrid RF device 62H for further splitting and routing to antenna elements 56 and 58.

The second component signal of the sum beam pattern 61 produced by the 180° hybrid RF device 68 is alternatively sent to SP2T switch 66E. This signal is then sent to SP2T switch 66F, through Port H, through phase shifter 64F, and then to the 90° hybrid RF device 62F. The 90° hybrid RF device 62F further splits the second component signal into a second-first component signal and a second—second component signal. The second-first component signal is sent through phase shifter 64H and then to 90° hybrid RF device 62G for further splitting and routing to antenna elements 55 and 57. The second—second component signal is sent to 90° hybrid RF device 62H for further splitting and routing to antenna elements 56 and 58.

The difference beam pattern 63 is also routed to the 180° hybrid RF device 68. This device again splits the difference beam pattern 63 into two component signals. These two component signals are processed in a manner similar to the two component signals for the sum beam pattern 61 described above for beam location E.

FIG. 25 shows the signal characteristics for both the sum beam pattern 61 and difference beam pattern 63 produced by the beam forming network shown in FIG. 22. In particular, referring to the fourth column of the two charts shown on FIG. 25, the resultant signals produced at elements 51–58 by the beam forming network have an amplitude (dB) and phase (deg) that will result in the sum beam pattern 61 and the difference beam pattern 63 being produced at beam location E.

The hardware used by the beam forming network 60 developed in accordance with the present invention functions based on a specific operational protocol. This aspect of the invention is described in detail below.

Figure 26:
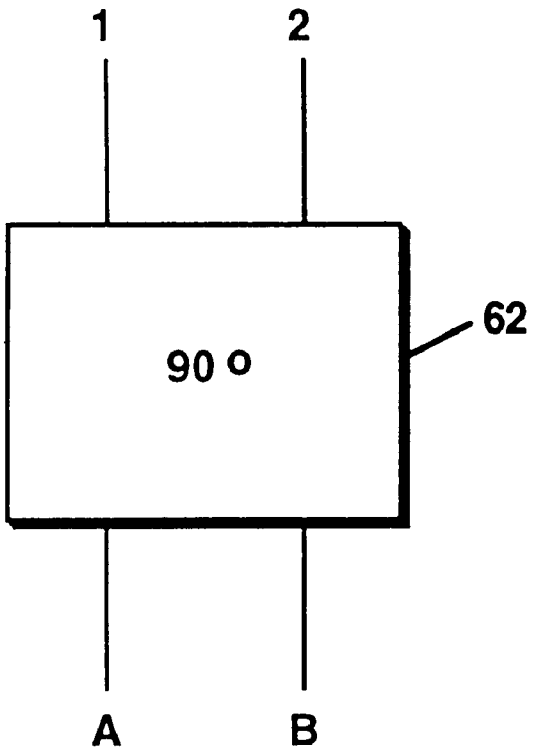
FIG. 26 illustrates a 90° RF hybrid devices 62 used in accordance with the present invention; and, FIG. 27 illustrates a 180° RF hybrid devices 68 used in accordance with the present invention.

Each 90° hybrid RF device 62 used by the beam forming network 60, as shown in FIG. 26, has an input A and an input B. A signal entering this device through either input A or input B will be split into component signals 1 and 2. For example, a signal entering input A with an amplitude of 1 V and a phase of 0° will be split into a first component signal 1 with an amplitude of V and phase of 0° and a second component signal 2 with an amplitude of V and phase of +90°. Similarly, a signal entering the device through input B with an amplitude 1 V and phase of 0° will be split into a first component signal 1 with an amplitude of V and phase of +90° and a second component signal 2 with an amplitude of V and phase of 0°.

Figure 27:
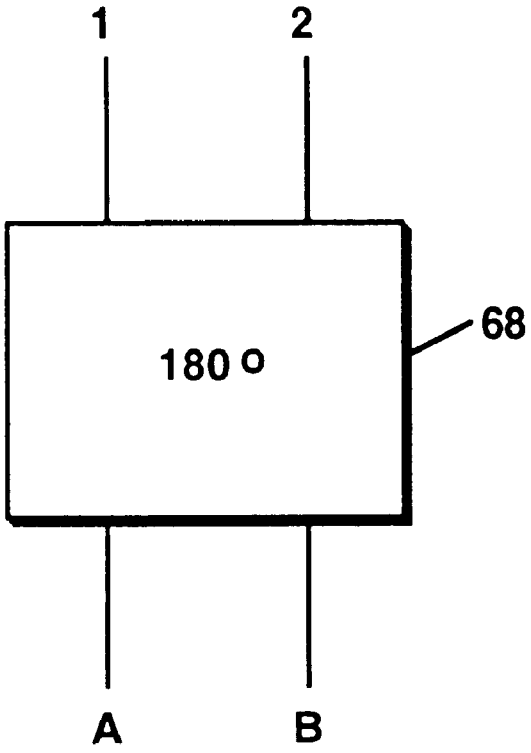

Also, as shown in FIG. 27, the 180° hybrid RF device 68 used by the beam forming network 60 has an input A and an input B. A signal entering the device through input A with an amplitude of 1 V and phase of 0° will be split into a first component signal 1 with an amplitude of V and phase of 0° and a second component signal 2 with an amplitude of V and phase of 0°. Similarly, a signal entering the device through input B with an amplitude 1 V and phase of 0° will be split into a first component signal 1 with an amplitude of V and phase of 0° and a second component signal 2 with an amplitude of V and phase of 180°.

Each of the fixed line length phased shifters 64 used by the beam forming network 60 are preset to adjust the phase of an incoming signal in increments of 45°. In particular, the phase shifter 64A adjusts the phase of an incoming signal by +45°, the phase shifter 64B adjusts the phase of an incoming signal by −135°, the phase shifter 64C adjusts the phase of an incoming signal by −45°, the phase shifter 64D adjusts the phase of an incoming signal by +45°, the phase shifter 64E adjusts the phase of an incoming signal by −135°, the phase shifter 64F adjusts the phase of an incoming signal by +45°, the phase shifter 64G adjusts the phase of an incoming signal by +45°, and the phase shifter 64H adjusts the phase of an incoming signal by −45°.

Lastly, each of the SP2T switches 66 includes one stationary pole and two alternating poles. The SP2T switches, as shown throughout the drawings, can be used to connect two alternating inputs to one output, or to connect one input to two alternating outputs.

The present invention is not to be considered limited in scope by the preferred embodiments described in the specification. Additional advantages and modifications, which will readily occur to those skilled in the art from consideration of the specification and practice of the invention, are intended to be within the scope and spirit of the following claims.

I claim:

1. An antenna array for identifying devices operating in a region of interest, said antenna comprising:

antenna means including eight individual antenna elements for transmitting sum and difference beam patterns to five separate beam locations in space; and a beam forming means for receiving, processing and routing said sum and difference beam patterns to said antenna means;

wherein said sum and difference beam patterns are radiated to beam locations one through two when antenna elements one through four are excited;

said sum and difference beam patterns are radiated to beam location three when antenna elements one through eight are excited; and said sum and difference beam patterns are radiated to beam locations four through five when antenna elements five through eight are excited.

2. An antenna array according to claim 1, wherein said beam forming means further includes:

eight 90° RF hybrid devices, where each of said 90° hybrid devices includes two inputs and two outputs;

eight fixed line length phase shifters, where each of said phase shifters includes one input and one output;

six single pole double throw switches (SB2T), where each of said SB2T switches includes one stationary pole and two alternating poles; and a 180° hybrid RF device which includes two inputs and two outputs.

3. An antenna array according to claim 2, wherein said phase shifters are preset to adjust the phase of an incoming signal in increments of 45°.

4. An antenna array according to claim 2, wherein:

a signal entering a 90° RF hybrid device through the first input with an amplitude of 1 V and a phase of 0° will be split into two output signals, where the first output signal has an amplitude of V and phase of 0° and the second output signal has an amplitude of V and phase of +90°; and a signal entering a 90° RF hybrid device through the second input with an amplitude of 1 V and phase of 0° will be split into two output signals, where the first output signal has an amplitude of V and phase of +90° and the second output signal has an amplitude of V and phase of 0°.

5. An antenna array according to claim 2, wherein:

a signal entering a 180° RF hybrid device through the first input with an amplitude of 1 V and a phase of 0° will be split into two output signals, where the first output signal has an amplitude of V and phase of 0° and the second output signal has an amplitude of V and phase of 0°; and a signal entering a 180° RF hybrid device through the second input with an amplitude of 1 V and phase of 0° will be split into two output signals, where the first output signal has an amplitude of V and phase of 0° and the second output signal has an amplitude of V and phase of 180°.

6. A method for identifying devices operating in a region of interest, said method comprising the steps of:

(1) routing sum and difference beam patterns to a beam forming network;

(2) processing said sum and difference beam patterns at said beam forming network to form up to eight output sum and difference beam patterns said processing comprising the steps of:

(i) routing the sum and difference beam patterns to a 180° hybrid RF device;

(ii) routing the sum and difference beam patterns from step (i) through at least one single pole double throw switch (SB2T);

(iii)routing the sum and difference beam patterns from step (ii) through at least one fixed line length phase shifter; and (iv) routing the sum and difference beam patterns from step (iii) through a plurality of 90° hybrid devices;

(3) routing said output sum and difference beam patterns to a plurality of antenna elements; and (4) transmitting said output sum and difference beam patterns to five separate beam locations in space.

7. A method for identifying devices operating in a region of interest, said method comprising the steps of:

(1) routing sum and difference beam patterns to a beam forming network;

(2) processing said sum and difference beam patterns at said beam forming network to form up to eight output sum and difference beam patterns;

(3) routing said output sum and difference beam patterns to a plurality of antenna elements; and (4) transmitting said output sum and difference beam patterns to five separate beam locations in space wherein:

said plurality of antenna elements includes eight individual antenna elements;

said sum and difference beam patterns are radiated to beam locations one through two when antenna elements one through four are excited;

said sum and difference beam patterns are radiated to beam location three when antenna elements one through eight are excited; and said sum and difference beam patterns are radiated to beam locations four through five when antenna elements five through eight are excited.

8. A beam forming network for use with an antenna array, said beam forming network comprising:

eight 90° RF hybrid devices, where each of said 90° RF hybrid devices include two inputs and two outputs;

eight fixed line length phase shifters, where each of said phase shifters include on input and one output;

six single pole double throw switches (SB2T), where each of said SB2T switches includes one stationary pole and two alternating poles; and, a 180° hybrid RF device which includes two inputs and two outputs.

9. A beam forming network antenna according to claim 8, wherein said phase shifters are preset to adjust the phase of an incoming signal in increments of 45°.

10. A beam forming network according to claim 8, wherein:

a signal entering a 90° RF hybrid device through the first input with an amplitude of 1 V and a phase of 0° will be split into two output signals, where the first output signal has an amplitude of V and phase of 0° and the second output signal has an amplitude of V and phase of +90°; and a signal entering a 90° RF hybrid device through the second input with an amplitude of 1 V and phase of 0° will be split into two output signals, where the first output signal has an amplitude of V and phase of +90° and the second output signal has an amplitude of V and phase of 0°.

11. An antenna array comprising:

(1) a plurality of antenna elements for transmitting respective sum and difference beam patterns to five separate beam locations; and (2) a beam forming network for receiving, processing and routing said sum and difference beam patterns to said antenna elements, said beam forming network comprising:

(i) at least one 90° hybrid device including two inputs and two outputs;

(ii) at least one fixed line length phase shifter including one input and one output;

(iii) at least one single pole double throw switch (SB2T) including one stationary pole and two alternating poles; and (iv) a 180° hybrid RF device which includes two inputs and two outputs.

12. The antenna array of claim 11 wherein the beam forming network comprises eight 90° RF hybrid devices, eight fixed line length phase shifters, and six single pole double throw switches (SB2T).

13. The antenna array of claim 11 wherein the plurality of antenna elements comprises eight antenna elements.

14. The antenna array of claim 11 wherein:

said sum and difference beam patterns are radiated to beam locations one through two when antenna elements one through four are excited;

said sum and difference beam patterns are radiated to beam location three when antenna elements one through eight are excited; and sum and difference beam patterns are radiated to beam locations four through five when antenna elements five through eight are excited.

15. The antenna array of claim 11 wherein said at least one phase shifter is preset to adjust the phase of an incoming signal in increments of 45°.

16. The antenna array of claim 11 wherein:

a signal entering a 90° RF hybrid device through the first input with an amplitude of 1 V and a phase of 0° will be split into two output signals, where the first output signal has an amplitude of V and phase of 0°; and the second output signal has an amplitude of V and a phase of +90°; and a signal entering a 90° RF hybrid device through the second input with an amplitude of 1 V and phase of 0° will be split into two output signals, where the first output signal has an amplitude of V and a phase of +90° and the second output signal has an amplitude of V and phase of 0°.

17. The antenna array of claim 11 wherein:

a signal entering a 180° RF hybrid device through the first input with an amplitude of 1 V and a phase of 0° will be split into two output signals, where the first output signal has an amplitude of V and phase of 0° and the second output signal has an amplitude of V and phase of 0°; and a signal entering a 180° RF hybrid device through the second input with an amplitude of 1 V and phase of 0° will be split into two output signals, where the first output signal has an amplitude of V and phase of 0° and the second output signal has an amplitude of V and phase of 180°.

18. The method of claim 6 wherein said step of routing the sum and difference beam patterns from step (ii) through at least one fixed line length phase shifter includes the step of adjusting the phase of an incoming signal in increments of 45°.

19. The method of claim 7 wherein said processing step comprises the steps of:

(i) routing the sum and difference beam patterns to a 180° hybrid RF device;

(ii) routing the sum and difference beam patterns from step (i) through at least one single pole double throw switch (SB2T);

(iii)routing the sum and difference beam patterns from step (ii) through at least one fixed line length phase shifter; and (iv) routing the sum and difference beam patterns from step (iii) through a plurality of 90° hybrid devices.

20. The method of claim 19 wherein said step of routing the sum and difference beam patterns from step (ii) through at least one fixed line length phase shifter includes the step of adjusting the phase of an incoming signal in increments of 45°.

* * * * *